US011296442B2

(12) United States Patent
Hayashi et al.

(10) Patent No.: US 11,296,442 B2
(45) Date of Patent: Apr. 5, 2022

(54) CONNECTOR AND SOCKET USED FOR THE SAME

(71) Applicant: Panasonic Intellectual Property Management Co., Ltd., Osaka (JP)

(72) Inventors: Takuya Hayashi, Mie (JP); Yoji Miyazaki, Mie (JP); Kazumasa Iijima, Kyoto (JP); Yasushi Ono, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/891,156

(22) Filed: Jun. 3, 2020

(65) Prior Publication Data

US 2021/0044041 A1 Feb. 11, 2021

(30) Foreign Application Priority Data

Aug. 8, 2019 (JP) ..... JP2019-146162

(51) Int. Cl.
*H01R 12/71* (2011.01)
*H01R 13/20* (2006.01)
(Continued)

(52) U.S. Cl.
CPC ..... *H01R 12/716* (2013.01); *H01R 12/707* (2013.01); *H01R 12/73* (2013.01);
(Continued)

(58) Field of Classification Search
CPC .... H01R 12/716; H01R 12/707; H01R 12/73; H01R 13/11; H01R 13/20; H01R 13/502; H01R 13/6581
(Continued)

(56) References Cited

U.S. PATENT DOCUMENTS 6,551,139 B1 * 4/2003 Yu ..... H01R 13/6594 439/607.22
7,052,286 B2 * 5/2006 Zhang ..... H01R 43/0256 439/74
(Continued)

FOREIGN PATENT DOCUMENTS

JP 2017-033655 2/2017
JP 2018-152190 9/2018
JP 2019-040823 3/2019

*Primary Examiner* — Peter G Leigh
(74) *Attorney, Agent, or Firm* — McDermott Will & Emery LLP

(57) ABSTRACT

A socket of a connector includes a socket housing, a socket terminal element, and an outer shield element. The socket housing includes a bottom plate, and first and second side wall portions facing each other and provided on an upper surface of the bottom plate. The outer shield element includes a main body portion disposed on an outer surface of the first side wall portion, a contact portion extending from the main body portion to the inner surface of the first side wall portion, and an outer shield terminal portion extending from the main body portion toward the bottom plate. The contact portion is configured to be electrically connected to an outside of the socket housing. The outer shield terminal is electrically connected to the contact portion via the main body portion. This connector suppresses generation of unnecessary radiation and noise, and also suppresses interference between high-frequency signals.

19 Claims, 12 Drawing Sheets

(51) Int. Cl.

| | |
|---|---|
| ***H01R 13/11*** | (2006.01) |
| ***H01R 13/6581*** | (2011.01) |
| ***H01R 12/70*** | (2011.01) |
| ***H01R 12/73*** | (2011.01) |
| ***H01R 13/502*** | (2006.01) |

(52) U.S. Cl.
CPC ..... *H01R 13/11* (2013.01); *H01R 13/20* (2013.01); *H01R 13/502* (2013.01); *H01R 13/6581* (2013.01)

(58) Field of Classification Search
USPC ..... 439/78
See application file for complete search history.

(56) References Cited

U.S. PATENT DOCUMENTS 7,059,908 B2 * 6/2006 Yamaguchi ..... H01R 13/6583 439/607.17
7,070,423 B2 * 7/2006 Zhang ..... H01R 13/41 439/74
7,144,277 B2 * 12/2006 Pan ..... H01R 12/716 439/660
7,410,364 B2 * 8/2008 Kishi ..... H01R 12/716 439/566
7,585,185 B2 * 9/2009 Obikane ..... H01R 12/52 439/607.01
7,845,987 B2 * 12/2010 Yamada ..... H01R 12/716 439/680
8,105,112 B2 * 1/2012 Midorikawa ..... H01R 12/716 439/607.35
8,992,234 B2 * 3/2015 Yoshioka ..... H01R 12/7029 439/74
9,209,557 B2 * 12/2015 Kobayashi ..... H01R 12/91
9,246,279 B2 * 1/2016 Kato ..... H01R 13/6597
9,300,064 B2 * 3/2016 Takenaga ..... H01R 13/6582
9,325,103 B2 * 4/2016 Arai ..... H01R 13/5219
9,391,398 B2 * 7/2016 Omodachi ..... H01R 12/716
9,478,902 B2 * 10/2016 Komoto ..... H01R 13/627
9,543,675 B1 * 1/2017 Takenaga ..... H01R 12/716
9,614,308 B2 * 4/2017 Ozeki ..... H01R 12/716
9,843,117 B2 * 12/2017 Yoshioka ..... H01R 12/707
10,084,265 B2 * 9/2018 Ozeki ..... H01R 13/6581
2017/0033479 A1 2/2017 Ozeki
2017/0365944 A1 * 12/2017 Yoshioka ..... H01R 12/91
2018/0198241 A1 * 7/2018 Ooi ..... H01R 13/6597
2018/0205165 A1 * 7/2018 Hoshiba ..... H01R 13/646
2018/0316107 A1 * 11/2018 Yoshioka ..... H01R 4/02
2019/0074622 A1 * 3/2019 Takenaga ..... H01R 13/41
2020/0006874 A1 1/2020 Ueda

* cited by examiner

CONNECTOR AND SOCKET USED FOR THE SAME

TECHNICAL FIELD

The present disclosure relates to a connector including a header and a socket.

BACKGROUND ART

Japanese Patent Laid-Open Publication No. 2018-152190 discloses a conventional connector including a socket including plural socket side terminals on a socket main body, and a header including plural header side terminals on a header main body.

In a the connector disclosed in Japanese Patent Laid-Open Publication No. 2018-152190, a connector (socket) held on a first board and a header held on a second board are fitted while the socket faces the header. Circuit patterns of the board to which the terminals are connected are electrically connected to each other by the corresponding terminals contacting each other to be electrically connected.

Japanese Patent Laid-Open Publication No. 2019-040823 and Japanese Patent Laid-Open Publication No. 2017-033655 disclose conventional connectors including terminals to which high-frequency (RF) signals are applied.

When RF signals are applied to terminals of the conventional connectors disclosed in Japanese Patent Laid-Open Publication No. 2019-040823 and Japanese Patent Laid-Open Publication No. 2017-033655, the connectors may require to suppress unnecessary radiation from the terminals or noise mixed in the terminals. Further, when different RF signals are applied to terminals of each connector, the connector may require to suppress interference between the RF signals.

SUMMARY

A socket of a connector includes a socket housing, a socket terminal element, and an outer shield element. The socket housing includes a bottom plate, a first side wall portion provided on an upper surface of the bottom plate and extending in a direction perpendicular to an upward direction, and a second side wall portion provided on the upper surface of the bottom plate and extending in the direction to face the first side wall portion. The socket terminal element is provided on an inner surface of the first side wall portion facing the second side wall portion. An outer shield portion is provided on an outer surface of the first side wall portion opposite to the inner surface. The outer shield element includes a main body disposed on the outer surface of the first side wall portion, a contact portion extending from the main body to the inner surface of the first side wall portion, and an outer shield terminal portion extending from the main body toward the bottom plate. The contact portion is configured to be electrically connected to an outside of the socket housing. The outer shield terminal is electrically connected to the contact portion via the main body.

This connector suppresses generation of unnecessary radiation and noise, and also suppresses interference between high-frequency signals.

DETAIL DETAILED DESCRIPTION OF PREFERRED EMBODIMENTS

Overview of Connector

Figure 1:
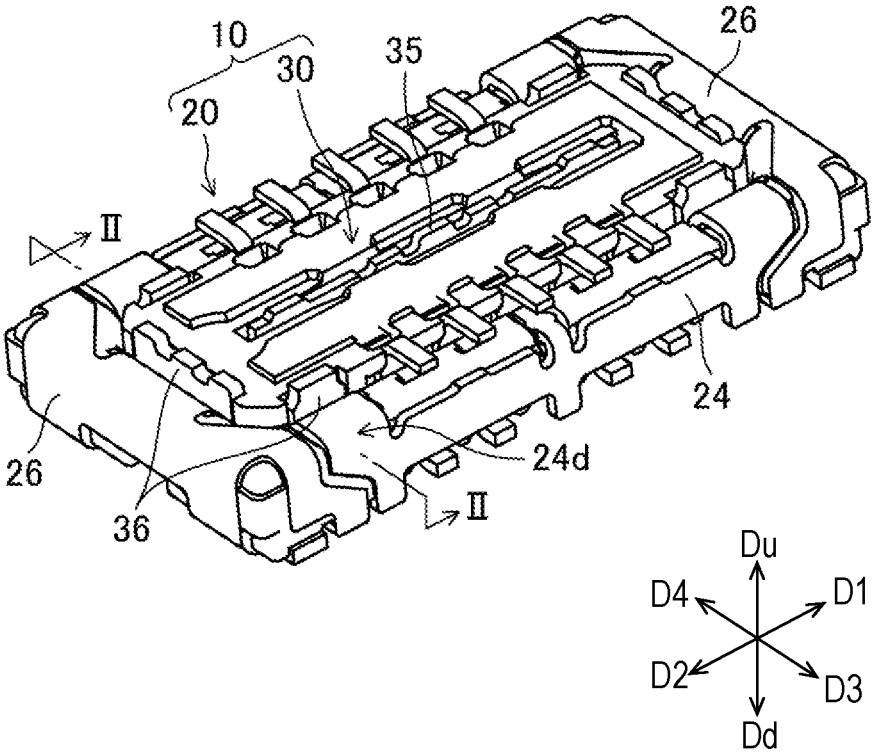
FIG. 1 is a perspective view of a connector according to an exemplary embodiment.
Figure 2:
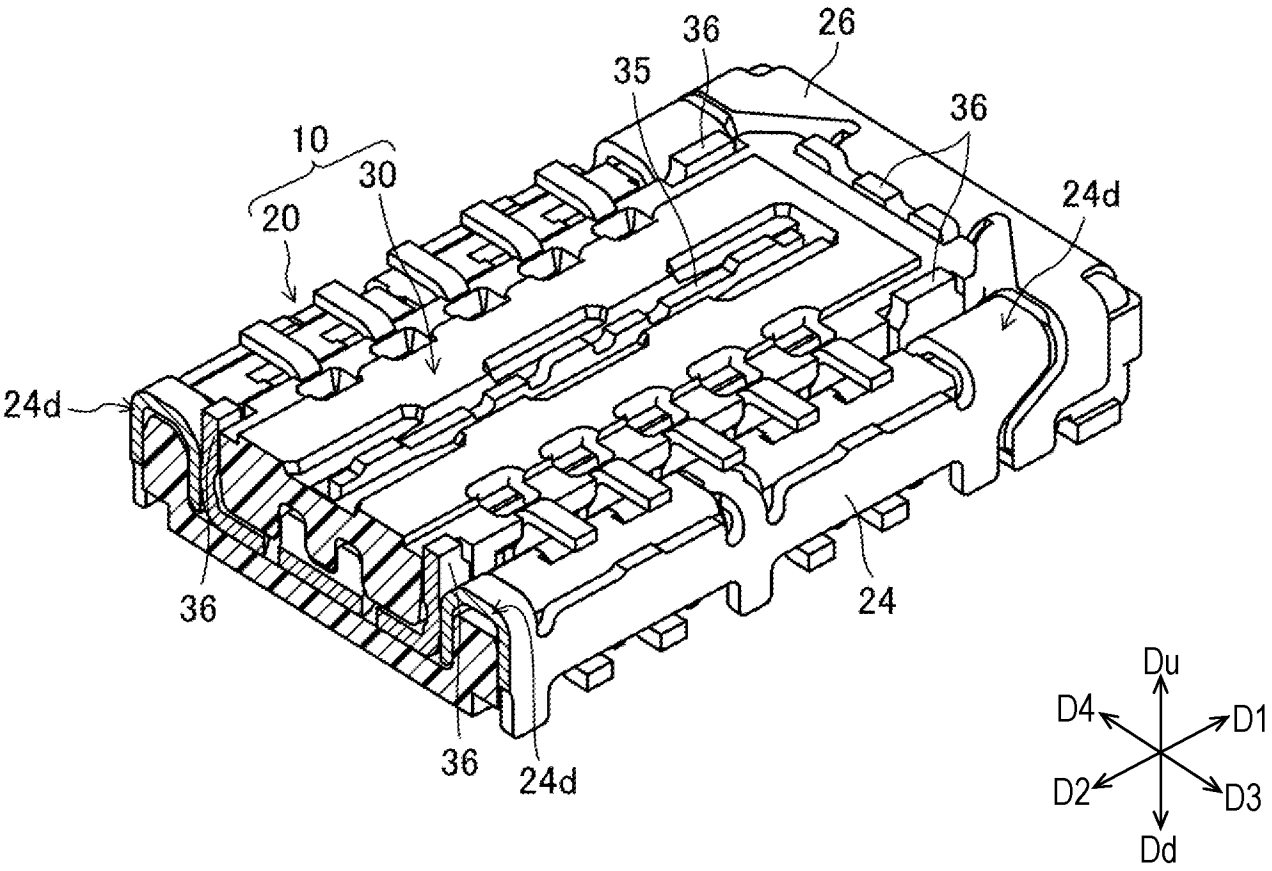
FIG. 2 is a perspective view of the connector illustrating a cross section of the connector along line II-II illustrated in FIG. 1.
Figure 3:
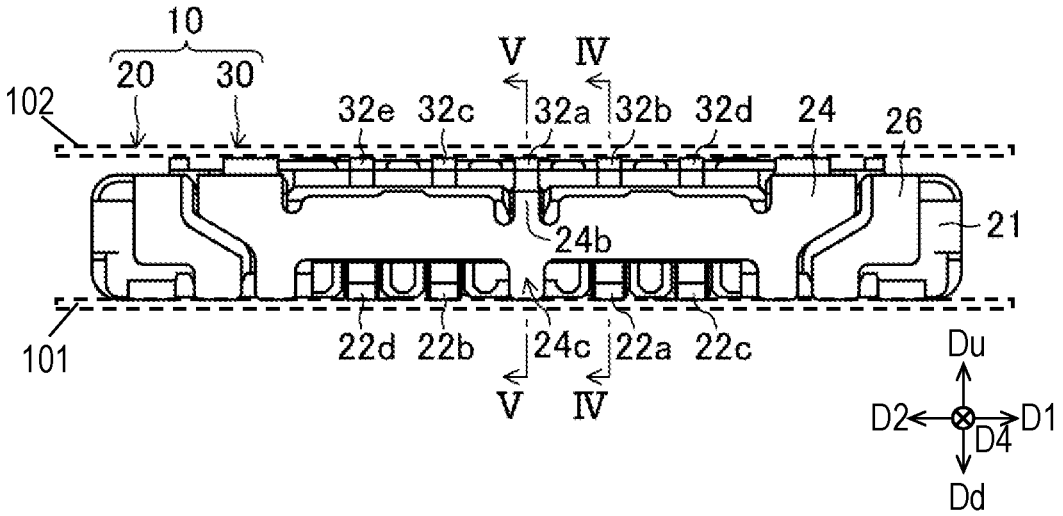
FIG. 3 is a front view of the connector according to the embodiment.
Figure 4:
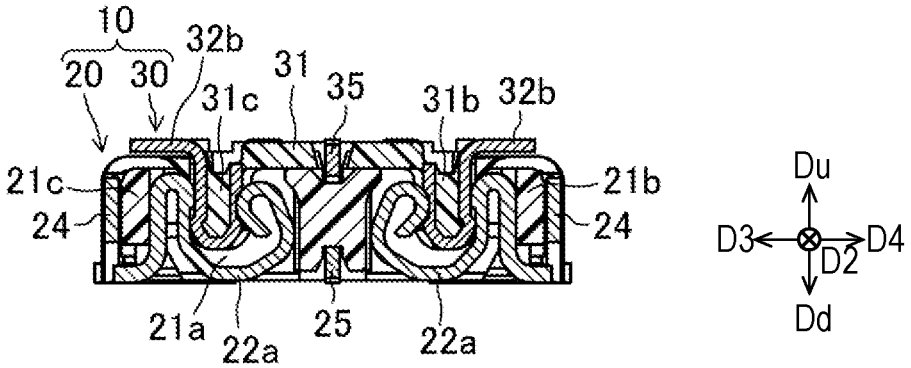
FIG. 4 is a cross-sectional view of the connector along line IV-IV illustrated in FIG. 3.
Figure 5:
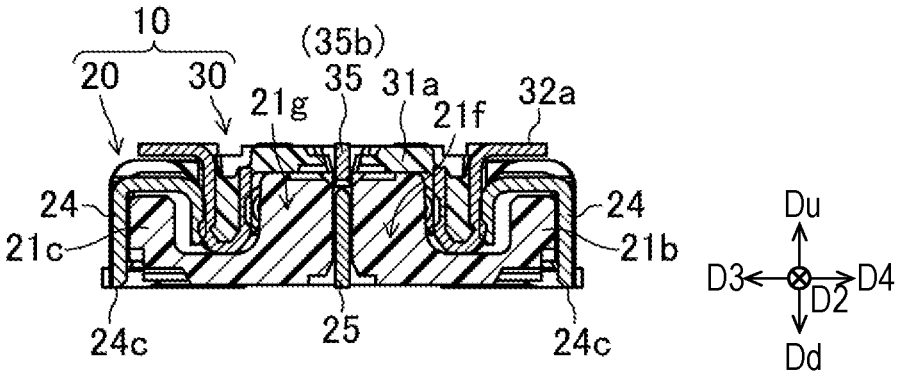
FIG. 5 is a cross-sectional view of the connector along line V-V illustrated in FIG. 3.
Figure 6:
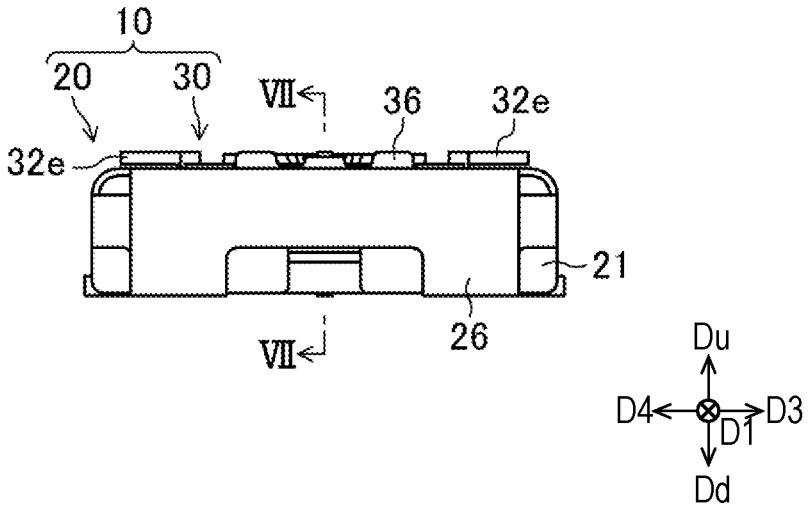
FIG. 6 is a left side view of the connector according to the embodiment.
Figure 7:
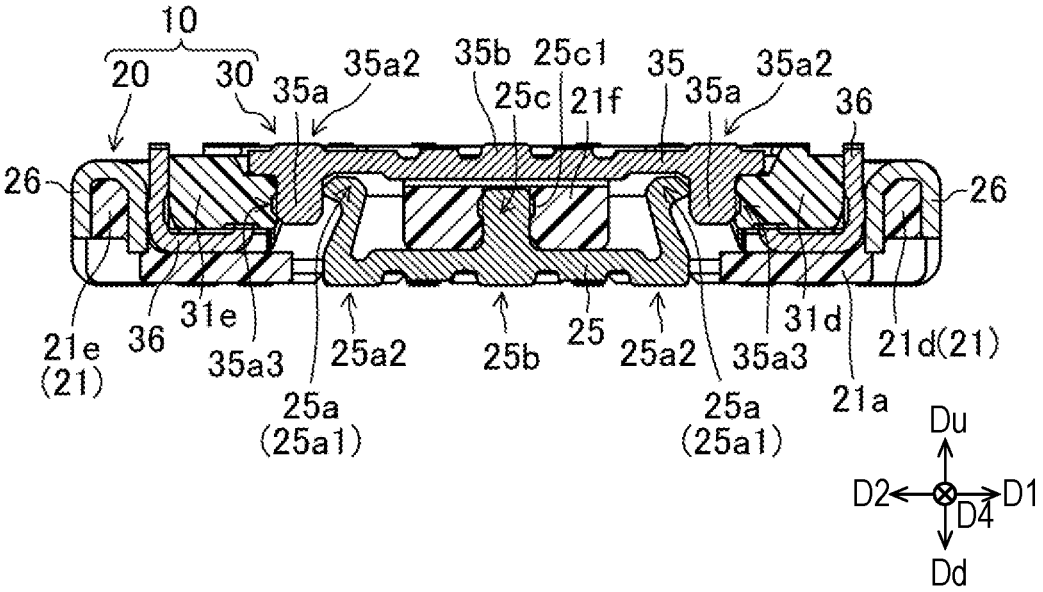
FIG. 7 is a cross-sectional view of the connector along line VII-VII illustrated in FIG. 6.

FIGS. 1 to 7 illustrate connector 10 according to an exemplary embodiment. FIG. 1 is a perspective view of connector 10. FIG. 2 is a perspective view of connector 10 illustrating a cross section of the connector along line II-II illustrated in FIG. 1. FIG. 3 is a front view of connector 10. FIG. 4 is a cross-sectional view of connector 10 along line IV-IV illustrated in FIG. 3. FIG. 5 is a sectional view of connector 10 along line V-V illustrated in FIG. 3. FIG. 6 is a left side view of connector 10. FIG. 7 is a cross-sectional view of connector 10 along line VII-VII illustrated in FIG. 6. In FIGS. 1 to 7, downward direction Dd, upward direction Du opposite to downward direction Dd, directions D1 and D2 perpendicular to downward direction Dd and opposite to each other, and directions D3 and D4 perpendicular to downward direction Dd and directions D1, D2 and opposite to each other are defined.

As illustrated in FIGS. 1 to 7, in connector 10 according to the embodiment socket 20 is fit to header 30 facing socket 20, thereby allowing corresponding terminals of socket 20 and header 30 to contact each other to be electrically connected to each other.

As illustrated in FIG. 3, socket 20 and header 30 are used by being mounted on board 101 and board 102, respectively. Boards 101 and 102, such as wiring boards or circuit board, have electric elements and wiring patterns provided thereon.

Structure of Socket

Figure 8:
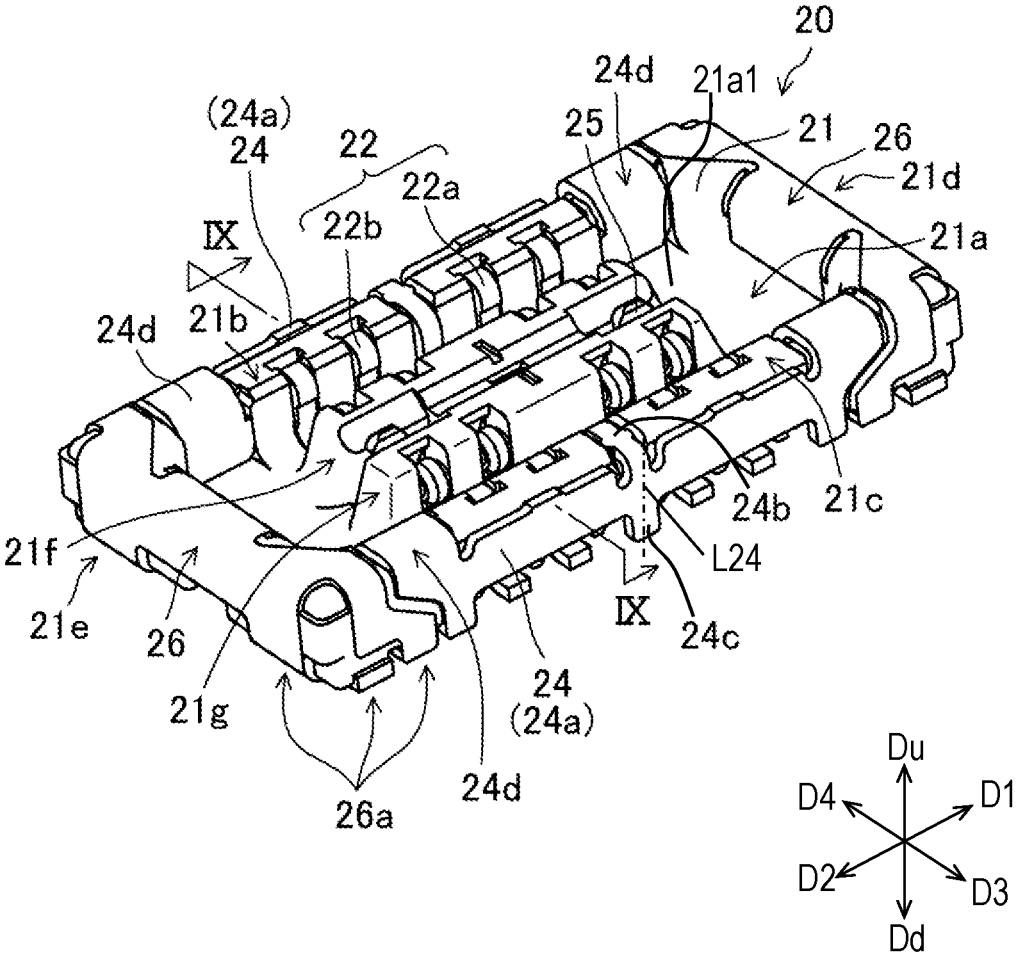
FIG. 8 is a perspective view of a socket of the connector according to the embodiment.
Figure 9:
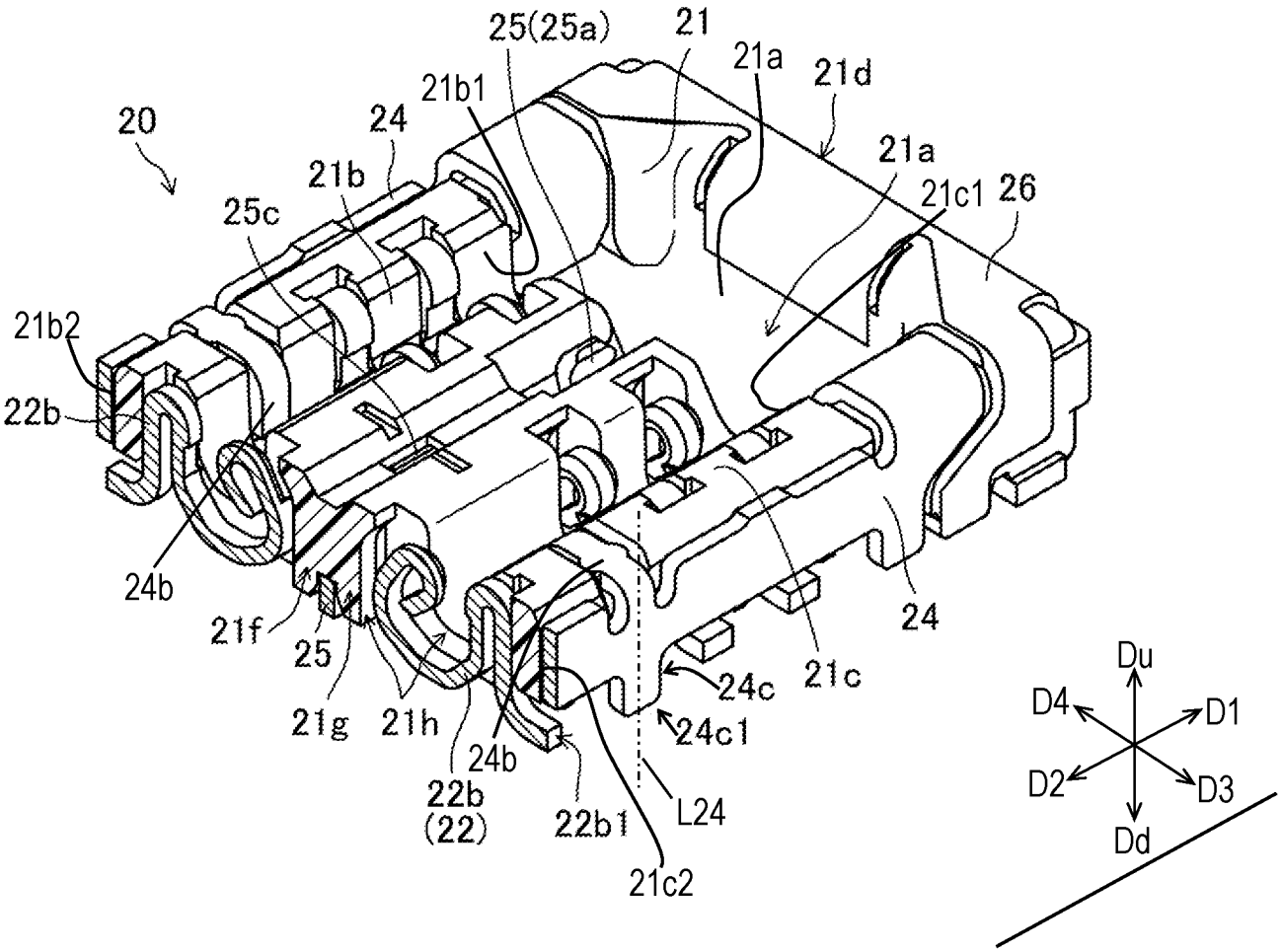
FIG. 9 is a perspective view of the socket illustrating a cross section of the socket along line IX-IX illustrated in FIG. 8.
Figure 10:
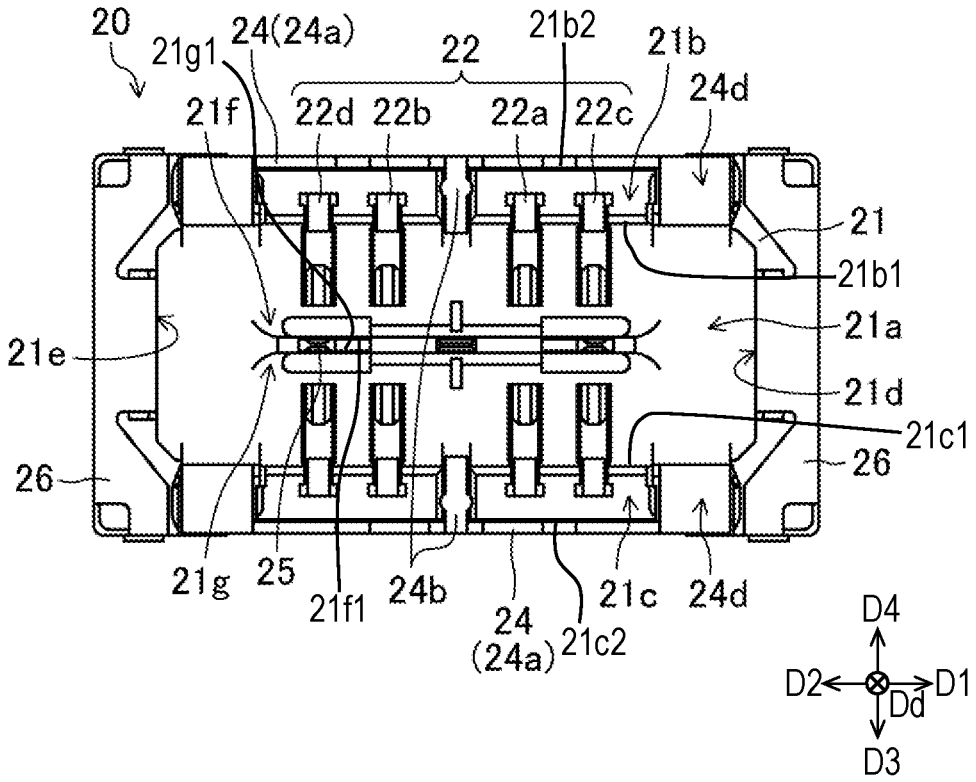
FIG. 10 is a plan view of the socket according to the embodiment.
Figure 11:
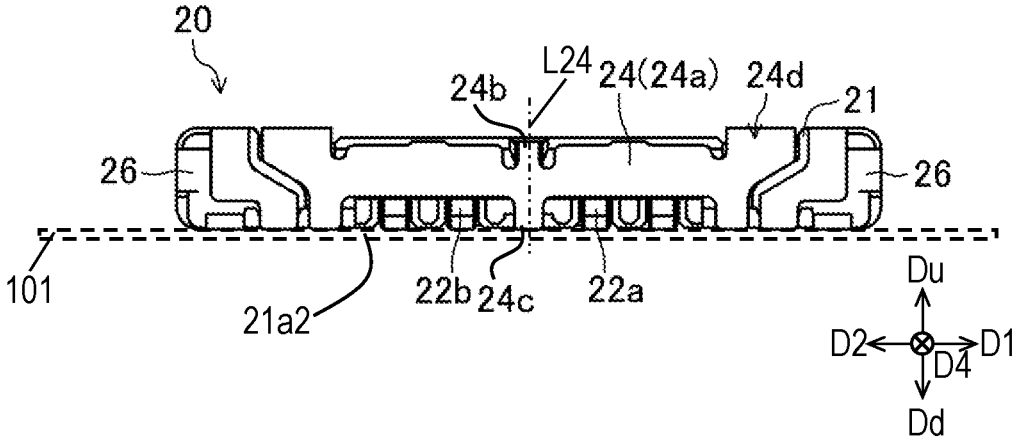
FIG. 11 is a front view of the socket according to the embodiment.
Figure 12:
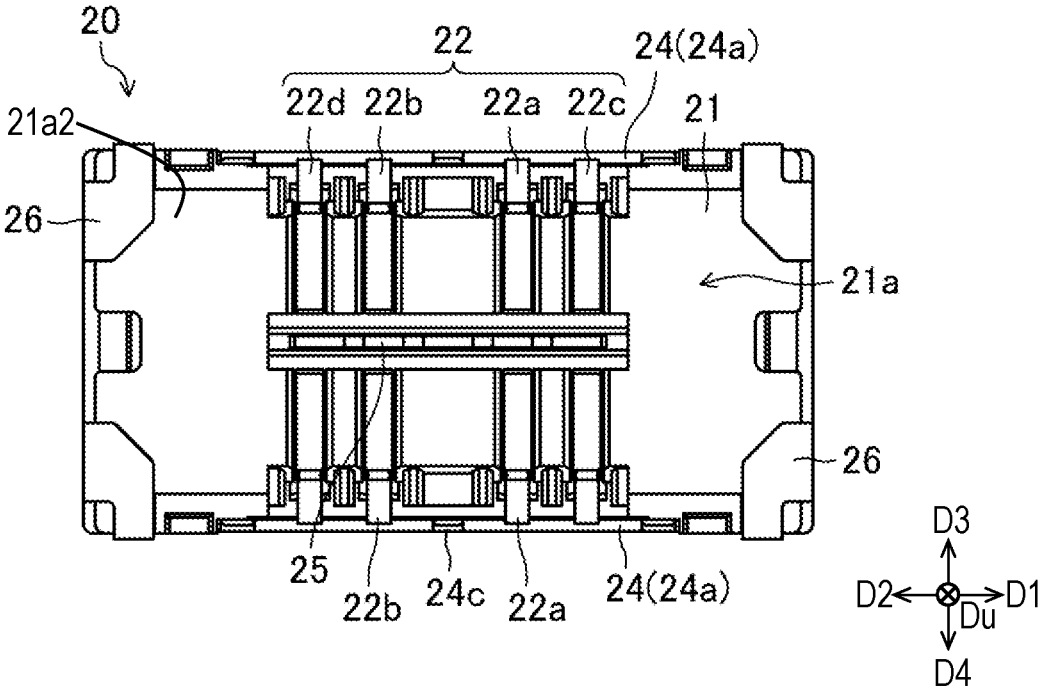
FIG. 12 is a bottom view of the socket according to the embodiment.

FIGS. 8 to 13 illustrate socket 20 constituting connector 10 according to the embodiment. FIG. 8 is a perspective view of socket 20. FIG. 9 is a perspective view of socket 20 illustrating a cross-section taken of socket 20 along line IX-IX illustrated in FIG. 8. FIG. 10 is a plan view of socket 20. FIG. 11 is a front view of socket 20. FIG. 12 is a bottom view of socket 20.

As illustrated in FIG. 8, socket 20 according to the embodiment includes socket housing 21 including bottom plate 21*a* having substantially, e.g. a planar rectangular shape, and side walls 21*b*, 21*c*, 21*d*, and 21*e* provided on upper surface 21*a*1 of bottom plate 21*a* around bottom plate 21*a*. Hereinafter, the side walls that face each other on long sides of the rectangular shape are referred to as socket side wall portions 21*b* and 21*c*. The side walls that face each other at short sides of the rectangular shape and connect socket side wall portions 21*b* and 21*c* to each other are referred to as socket side wall connection portions 21*d* and 21*e*. As illustrated in FIGS. 3 and 11, socket 20 is mounted on board 101 such that lower surface 21*a*2 of bottom plate 21*a* of socket housing 21 faces board 101.

Socket housing 21 is made of resin material having an insulating property, for example, a molded product if liquid crystal polymer (LCP).

As illustrated in FIGS. 4, 8 and 10, socket terminal elements 22 are provided on positions on socket side wall portions 21*b* and 21*c* of socket housing 21 facing each other. Each socket terminal element 22 includes terminal 22*a* located in direction D1 along socket side wall portion 21*b* from contact portion 24*b* provided at a substantially central portion of outer shield element 24, described later, and includes terminal 22*b* located in direction D2 opposite to direction D1 from contact portion 24*b*.

In socket 20 according to the embodiment, as an example, terminal 22*c* is disposed at a position in direction D1 from terminal 22*a*. Terminal 22*d* is disposed in direction D2 from terminal 22*b*.

Terminals 22*a*, 22*b*, 22*c*, and 22*d* have the same configuration, but do not necessarily have the same configuration.

A gold (Au) plating layer having a thickness equal to or less than 0.06 μm is formed at the upper surface of each of terminals 22*a*, 22*b*, 22*c*, and 22*d* facing header 30.

When the lower surfaces of terminals 22*a* to 22*d* are soldered, the plating layer prevents a solder material to creep up to the upper surfaces of the terminals. An excess amount of solder material does not adhere to the upper surface of the terminal, accordingly stabilizing high-frequency characteristics.

As illustrated in FIGS. 8 to 10, terminals 22*a* to 22*d* of socket terminal element 22 extend from socket side wall portion 21*b* to socket side wall portion 21*c*. Holding wall 21*f* that holds terminals 22*a* to 22*d* of socket terminal element 22 is provided between socket side wall portion 21*b* and socket side wall portion 21*c* on upper surface 21*a*1 of bottom plate 21*a* of socket housing 21.

Similarly, terminals 22*a* to 22*d* of socket terminal element 22 extend from socket side wall portion 21*c* toward socket side wall portion 21*b*. Holding wall 21*g* that holds terminals 22*a* to 22*d* of socket terminal element 22 is provided on upper surface 21*a*1 of bottom plate 21*a*. Holding walls 21*f* and 21*g* are formed unitarily with socket housing 21, for example. Holding walls 21*f* and 21*g* have inner surfaces 21*f*1 and 21*g*1 facing each other in directions D3 and D4, respectively. Inner surfaces 21*f*1 and 21*g*1 of holding walls 21*f* and 21*g* are partially joined to each other.

In accordance with the embodiment, as illustrated in FIG. 9, the lower portion of each of terminals 22*a* to 22*d*, for example, terminal 22*b*, is disposed inside recess 21*h* provided in bottom plate 21*a* of socket housing 21. In addition, the thickness of terminal 22*b* in upward direction Du (downward direction Dd) is smaller than the thickness of bottom plate 21*a* in upward direction Du (downward direction Dd). Therefore, as illustrated in FIG. 4, the lower portion (top) of terminal 32*b* of header 30 that fits to socket 20 contacts the upper surface of bottom plate 21*a* of socket 20 and stops. That is, the top of terminal 32*b* does not interfere with the upper surface of terminal 22*b*. Therefore, the height of connector 10 in downward direction Dd (upward direction Du) when socket 20 and header 30 are fitted is not affected by the lower portion of terminal 22*b*.

In accordance with the embodiment, recess 21*h* provided in upper surface 21*a*1 of bottom plate 21*a* of socket housing 21 and in which at least the lower portion of terminal 22*b* is fitted is a hole passing through bottom plate 21*a*. Recess 21*h* may be a groove having a bottom and provided in upper surface 21*a*1 of bottom plate 21*a*. However, even when recess 21*h* is a groove, the upper surface of terminal 22*b* disposed inside the groove is lower than upper surface 21*a*1 of bottom plate 21*a*. Terminal 32*b* of header 30 will be detailed later.

As illustrated in FIGS. 8 to 12, two holding brackets 26 are provided on socket side wall connection portions 21*d* and 21*e* of socket housing 21. Each of two holding brackets 26 covers ends of socket side wall portions 21*b* and 21*c* and lower surface 21*a*2 of bottom plate 21*a* which are located in respective one of directions D1 and D2. Holding brackets 26 increase the strength of socket side wall connection portions 21*d* and 21*e* in which outer shield element 24 is not provided in socket 20 and portions, particularly, corners, near socket side connection portions 21*d* and 21*e*.

Holding brackets 26 may be made of known metal plates made of, for example, alloy, such as copper alloy, including metal material.

In accordance with the embodiment, as illustrated in FIG. 8, socket terminal elements 22 of socket 20 are provided on two socket side wall portions 21*b* and 21*c* facing each other, but the present invention is not limited to this configuration. For example, socket terminal element 22 may be provided on only one of two socket side wall portions 21*b* and 21*c*, and may not be provided on the other socket side wall portion. In this case, one header terminal element 32 corresponding to socket terminal element 22 is provided also in header terminal element 32 of header 30.

Socket: Configuration of Outer Shield Element

Figure 13:
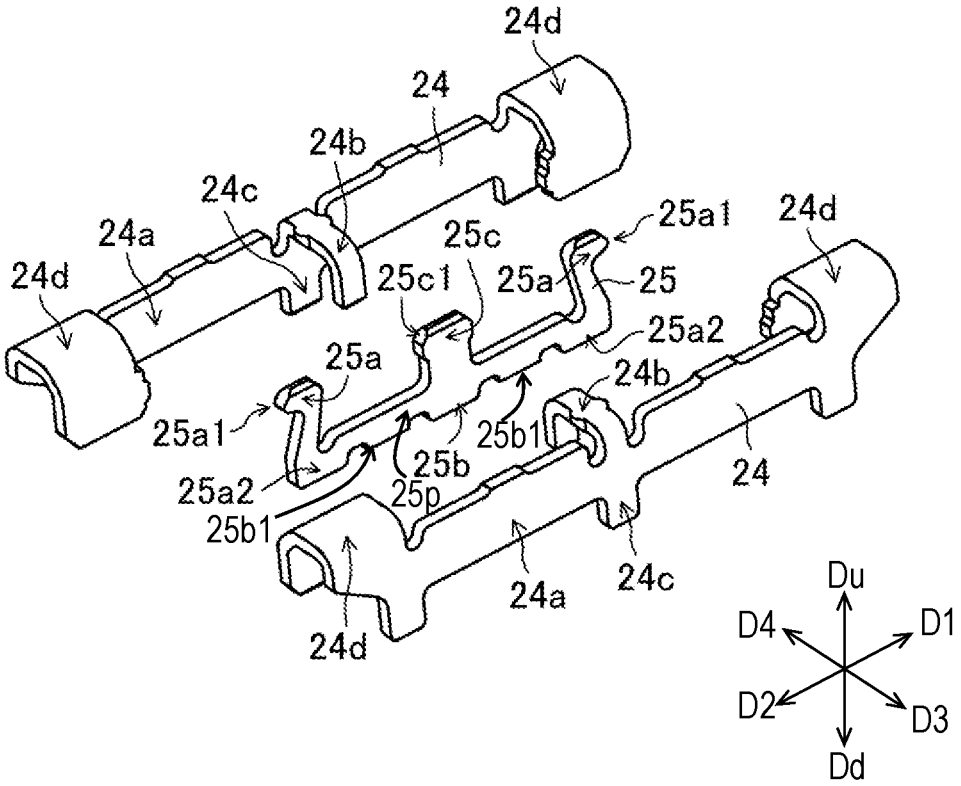
FIG. 13 is an exploded perspective view illustrating an outer shield element and a socket shield element of the socket according to the embodiment.

FIG. 13 is an exploded perspective view of socket 20 for illustrating outer shield element 24 and socket shield element 25. Socket side wall portion 21*b* has inner surface 21*b*1 facing socket side wall portion 21*c*, and outer surface 21*b*2 opposite to inner surface 21*b*1. Socket side wall portion 21*c* has inner surface 21*c*1 facing socket side wall portion 21*b*, and outer surface 21*c*2 opposite to inner surface 21*c*1. As illustrated in FIGS. 8 to 13, socket housing 21 includes two outer shield elements 24 provided on outer surfaces 21*b*2 and 21*c*2 of socket side wall portions 21*b* and 21*c*, respectively. Outer shield elements 24 have conductivity and have plate shapes.

Outer shield elements 24 include main bodies 24*a* disposed on outer surfaces 21*b*2 and 21*c*2 of socket side wall portions 21*b* and 21*c*, respectively. Main body 23*a* extends slenderly in directions D1 and D2.

Each of main bodies 24*a* includes contact portion 24*b* extending from the upper end of the central portion of each of main bodies 24*a* to respective one of inner surfaces 21*b*1 and 21*c*1 of socket side wall portions 21*b* and 21*c*. Contact portion 24*b* is configured to be electrically connected to an outside of socket housing 21, that is, to header 30.

Further, outer shield terminal portion 24*c* extends downward from the lower end of each of main bodies 24*a* toward the bottom plate 21*a* is provided at the lower end of main body 24*a* corresponding to contact portion 24*b*, that is, opposite to contact portion 24*b*. Outer shield terminal portion 24*c* is electrically connected to contact portion 24*b* via main body 24*a*. Therefore, in each outer shield element 24, contact portion 24*b* and outer shield terminal portion 24*c* are disposed on axis L24 extending in upward direction Du (downward direction Dd). This configuration minimizes a signal path, and improves the high-frequency characteristics of socket 20 (connector 10).

One outer shield element 24 includes two extension portions 24*d* extending from both ends of main body 24*a* in directions D1 and D2 to inner surface 21*b*1 of socket side wall portion 21*b*. The other outer shield element 24 includes two extension portions 24*d* extending from both ends of main body 24*a* in directions D1 and D2 to inner surface 21*c*1 of socket side wall portion 21*c*. While socket 20 is fitted to header 30, each extension portion 24*d* contacts holding brackets 36 of the header to be electrically connected (see FIGS. 1, 2, and 8).

As described above, each outer shield element 24 is separated from socket side wall connection portions 21*d* and 21*e* on and around respective one short side of socket housing 21 and holding bracket 26. Therefore, while socket 20 is fit to header 30, a preferable spring property can be imparted to each of outer shield elements 24. Further, the thickness, structure, and manufacturing method of each outer shield element 24 can be appropriately selected.

A signal applied to each of terminal 22*a* to 22*d* of socket terminal element 22 and contact portion 24*b* of outer shield element 24 will be described below.

For example, radio frequency (RF) signals may be applied to terminals 22*c* and 22*d* located at both ends of socket terminal element 22 provided on socket side wall portion 21*b*. Further, a ground potential (ground) may be applied to contact portion 24*b* and terminals 22*a* and 22*b* on both sides of contact portion 24*b*.

On the other hand, a ground potential (ground) may be applied to contact portion 24*b* of socket terminal element 22 on socket side wall portion 21*c* facing socket side wall portion 21*b*. Normal signals which do not include RF signals may be applied to terminals 22*a* and 22*b* on both sides of contact portion 24*b* and terminals 22*c* and 22*d* provided at both ends of socket terminal element 22.

Contact portion 24*b* of outer shield element 24 on socket side wall portion 21*c* is positioned at the center of a total of five members, i.e., four terminals 22*a* to 22*d* and contact portion 24*b*. However, when contact portion 24*b* is used as a ground terminal adjacent to a terminal having a normal signal applied thereto, contact portion 24*b* is not necessarily positioned at the center of the five members.

As illustrated in the bottom view of FIG. 12, two outer shield elements 24 according to the embodiment are disposed outside socket terminal element 22 in a width direction (directions D3 and D4). That is, socket terminal element 22 according to the embodiment is disposed between outer shield elements 24 in the width direction. That is, socket terminals portion 22 is disposed in the width direction and located between two outer shield elements 24. This configuration suppresses noise leaking outside socket 20 even if an RF signal is applied to socket terminal element 22.

As illustrated in FIG. 9, a surface direction along outer end surface 22*b*1 of each of terminals 22*a* to 22*d*, for example, terminal 22*b*, is substantially perpendicular to a surface direction along lower end surface 24*c*1 of outer shield terminal portion 24*c*. Thus, since outer end surface 22*b*1 of terminal 22*b* is covered with outer shield element 24, the size of connector 10 in direction D3 (the direction in which terminal 22*b* extends) can be reduced while suppressing unnecessary radiation.

Socket: Structure of Socket Shield Element

As illustrated in FIGS. 8 to 10, 12, and 13, socket shield element 25 having conductivity on upper surface 21*a*1 of bottom plate 21*a* in a region socket housing 21 between socket side wall portions 21*b* and 21*c*. Socket shield element 25 extends along socket side wall portions 21*b* and 21*c*.

Socket shield element 25 includes main body 25*p* extending slenderly in directions D1 and D2 and two socket shield terminals 25*a* extending from both ends of main body 25*p* above bottom plate 21*a*. Two socket shield terminals 25*a* are exposed upward from between holding walls 21*f* and 21*g*. Socket shield terminal 25*a* includes engaging portions 25*a*1 which protrudes outward in directions D1 and D2 opposite to each other which are longitudinal directions.

Each socket shield terminal 25*a* is configured to contact header shield terminal 35*a* of header shield element 35 of header 30 to be electrically connected thereto.

Socket shield element 25 includes socket shield terminal 25*b* exposed from lower surface 21*a*2 of bottom plate 21*a*. Socket shield terminal 25*b* is configured to be electrically connected to an outside of socket housing 21. More specifically, socket shield terminal 25*b* is configured to be electrically and mechanically connected to board 101 on which socket 20 is mounted by, e.g. soldering. As illustrated in FIG. 13, two terminals 25*b*1 having substantially the same shape are provided on both sides of socket shield terminal 25*b* in directions D1 and D2. Therefore, while the lower surface of socket shield element 25 is electrically and mechanically connected, at least one of three terminals 25*b* and 25*b*1 is connected to the board.

Protrusion 25*a*2 having the same height as the lower surface of socket shield terminal 25*b* is provided at a lower portion of the lower end of each socket shield terminal 25*a* of socket shield element 25. Protrusion 25*a*2 is configured to be electrically connected to the wiring board by, e.g. soldering. As described above, socket shield element 25 is soldered to the wiring board and the like at plural, at least three places, and improves high-frequency characteristics.

Socket shield element 25 includes holding portion 25*c* extending upward at the center of socket shield element 25. Holding portion 25*c* is held between two holding walls 21*f* and 21*g* described above. The top of holding portion 25*c* includes two protrusions 25*c*1 protruding in longitudinal directions D1 and D2. Two protrusions 25*c*1 of holding portion 25*c* are engaged with two holding walls 21*f* and 21*g*, respectively, to prevent socket shield element 25 from easily falling off from socket 20.

A metal plate made of metal material, such as copper alloy, may be used as a material of outer shield element 24 and socket shield element 25. In accordance with the embodiment, at least socket shield element 25 out of outer shield element 24 and socket shield element 25 may be made of material having a metal composition different from the metal composition of holding bracket 26. The thickness, structure and composition of socket shield element 25 are selected in accordance with the desired strength and the desired spring property in order to have a shape that exhibits elasticity when contacting header shield element 35.

As described above, socket shield element 25 of socket 20 according to the embodiment is held by holding walls 21*f* and 21*g* that hold respective inner portions of terminals 22*a* to 22*d* thereon. For this reason, socket shield element 25 functions as an electromagnetic shield that electromagnetically shields socket terminal elements 22 provided on socket side wall portions 21*b* and 21*c* opposite to each other, in various senses.

Structure of Header

Figure 14:
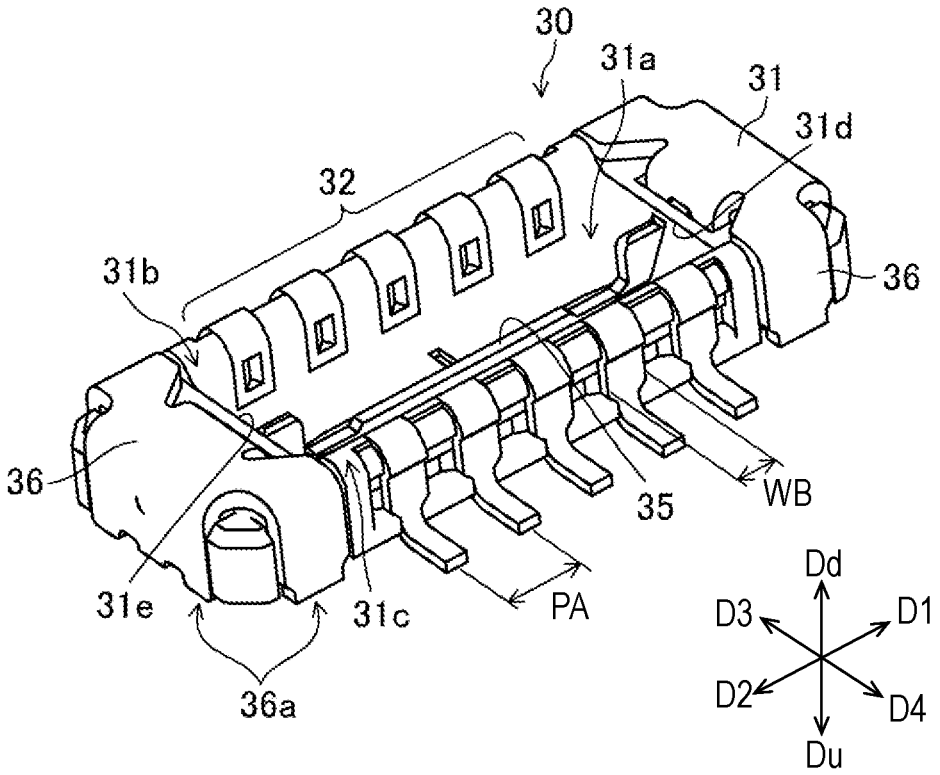
FIG. 14 is a perspective view of a header of the connector according to the embodiment.
Figure 15:
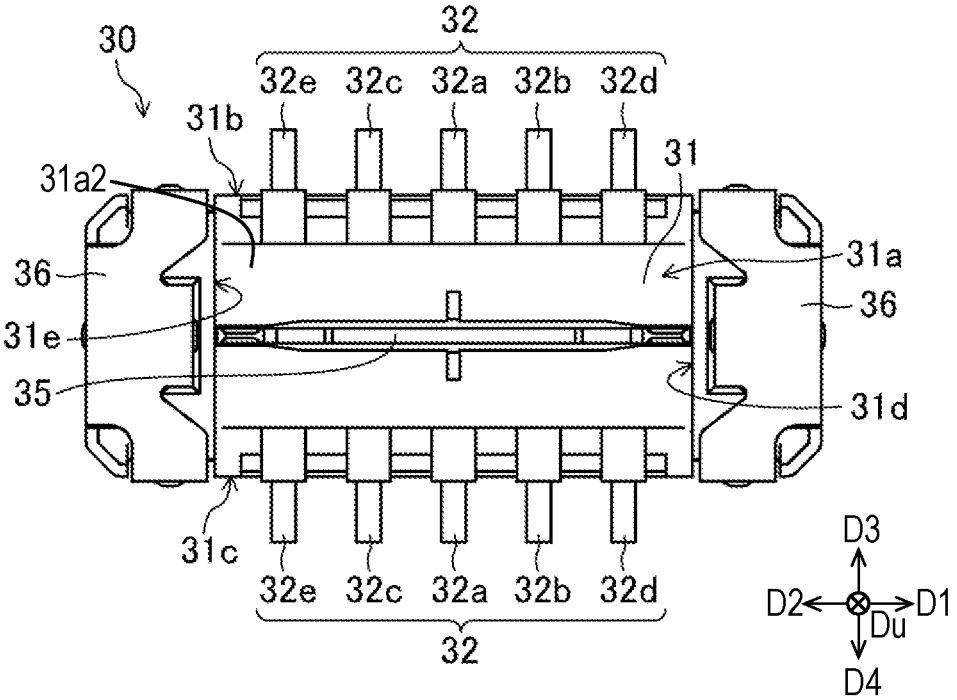
FIG. 15 is a plan view of the header according to the embodiment.
Figure 16:
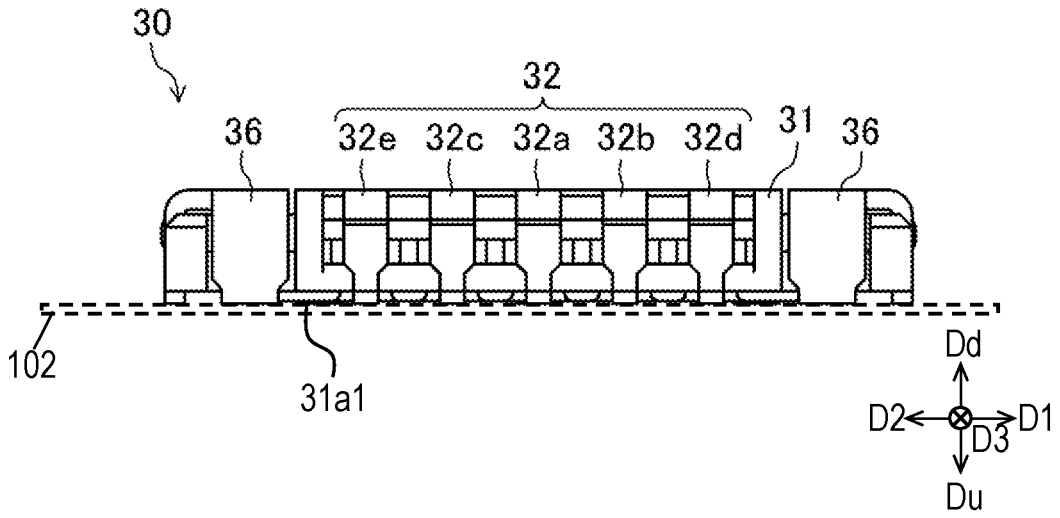
FIG. 16 is a front view of the header according to the embodiment.
Figure 17:
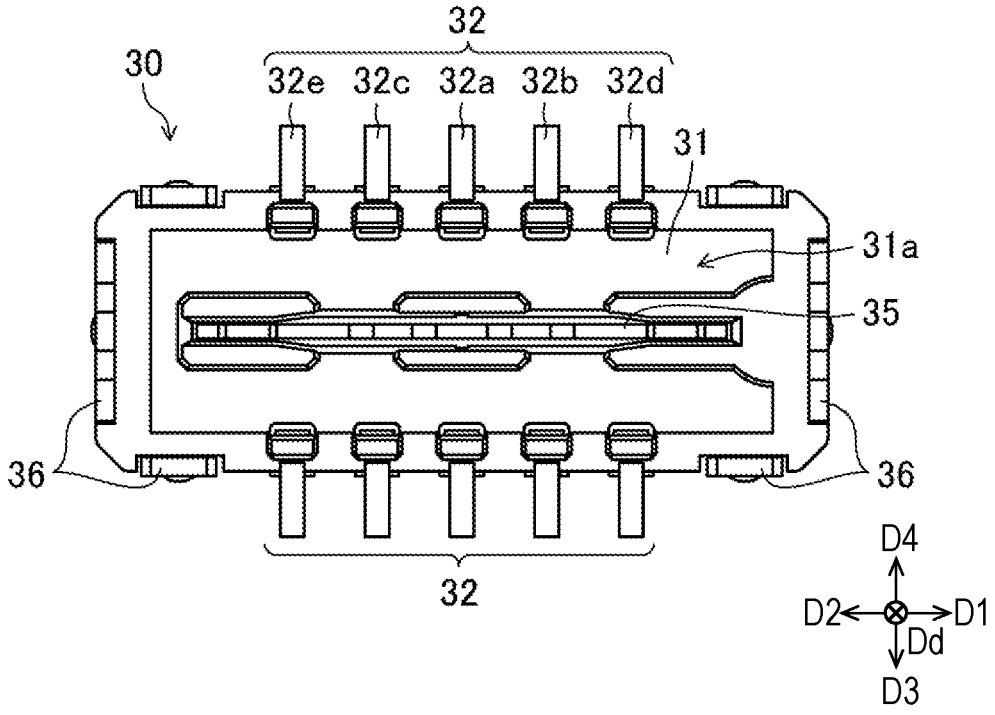
FIG. 17 is a bottom view of the header according to the embodiment.

FIGS. 14 to 17 illustrate header 30 of connector 10 according to the embodiment. FIG. 14 is a perspective view of header 30. FIG. 15 is a plan view of header 30. FIG. 16 is a front view of header 30. FIG. 17 is a bottom view of header 30.

As illustrated in FIG. 14, header 30 according to the embodiment includes header housing 31 including top plate 31*a* having substantially, e.g. a planar rectangular shape, and header side wall portions 31*b*, 31*c*, 31*d*, and 31*e* provided on lower surface 31*a*2 of top plate 31*a* at the periphery of top plate 31*a*. Header side wall portions 31*b* and 31*c* are opposed to each other on long side of the rectangular shape. Header side wall connection portions 31*d* and 31*e* are opposed to each other at short sides of the rectangular shape and are connected to header side wall portions 31*b* and 31*c*. As illustrated in FIGS. 3 and 16, header 30 is mounted on board 102 such that upper surface 31*a*1 of top plate 31*a* of header housing 31 faces board 102.

Similarly to socket housing 21, a molded product made of liquid crystal polymer (LCP), resin material having an insulating property, may be used for header housing 31 as well.

As illustrated in FIGS. 14 to 17, header terminal elements 32 are provided on positions on header side wall portions 31*b* and 31*c* of header housing 31 facing each other. Header terminal element 32 includes terminals 32*a* to 32*e*. Terminal 32*a* is configured to contact portion 24*b* of outer shield element 24 of socket 20 to be electrically connected to contact portion 24*b*. Terminal 32*b* is configured to contact terminal 22*a* of socket 20 to be electrically connected to terminal 22*a*. Terminal 32*c* is configured to contact terminal 22*b* of socket 20 to be electrically connected to terminal 22*b*. Terminal 32*d* is configured to contact terminal 22*c* of socket 20 to be electrically connected to terminal 22*c*. Terminal 32*e* is configured to contact terminal 22*d* of socket 20 and is electrically connected to terminal 22*d*.

Terminals 32*a* to 32*e* have the same configuration (shape), but are not limited to the same configuration.

A gold (Au) plating layer having a thickness equal to or less than 0.06 μm is formed at the lower surface of each of terminals 32*a* to 32*e* facing socket 20.

Thus, when the lower surfaces of terminals 32*a* to 32*e* are soldered, the solder material hardly creep up to the upper surfaces of terminals 32*a* to 32*e*. For this reason, an excessive amount of the solder material does not adhere to the upper surfaces of terminals 32*a* to 32*e*, thereby stabilizing the high-frequency characteristics.

Holding bracket 36 covering both ends of header side wall portion 31*b* is provided on header side wall connection portion 31*d* of header housing 31 while holding bracket 36 for covering both end portions of header side wall portion 31*c* is provided on header side wall connection portion 31*e*. Holding bracket 36 increases the strength of header side wall connection portions 31*d* and 31*e* and the portions (corners) in the vicinity thereof.

A metal plate made of, e.g. alloy containing metal material, such as copper alloy, may be used as a constituent material of holding brackets 36.

Header: Structure of Header Shield Element

As illustrated in FIGS. 14, 15, and 17, header shield element 35 having conductivity and a plate shape is provided between header side wall portions 31*b* and 31*c* on lower surface 31*a*2 of top plate 31*a* of header housing 31. Header shield element 35 extends parallel with header side wall portions 31*b* and 31*c*.

Figure 18:
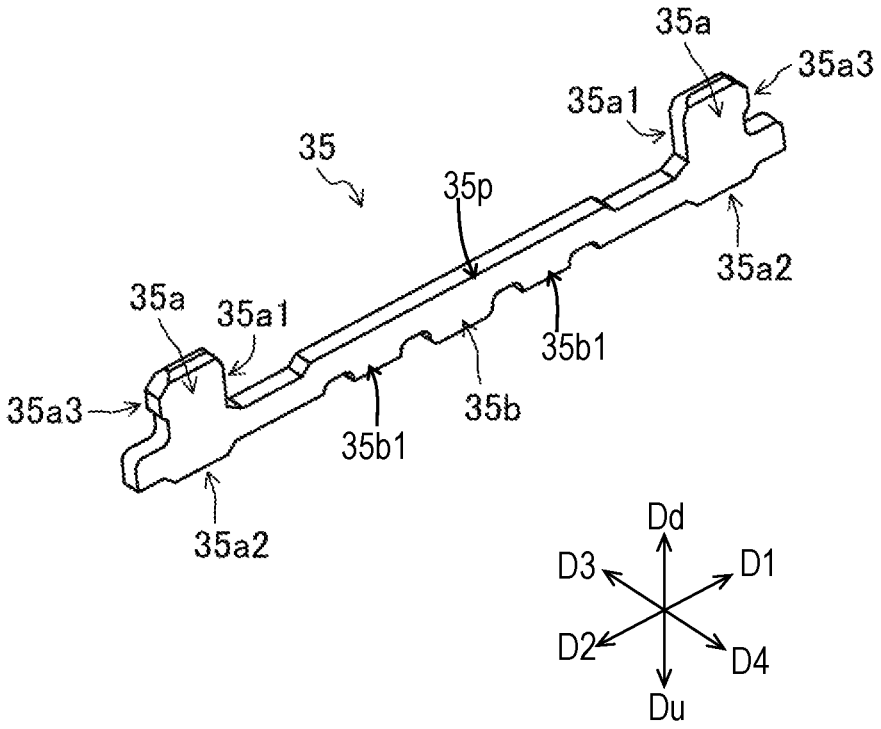
FIG. 18 is a perspective view of a header shield element constituting the header according to the embodiment.

FIG. 18 is a perspective view of header shield element 35. As illustrated in FIG. 18, header shield element 35 includes main body 35*p* extending slenderly in directions D1 and D2, and two header shield terminals 35*a* protruding from both ends of the lower surface of main body 35*p* in downward direction Dd.

Header shield element 35 includes header shield terminal 35*b* extending toward main body 35*p* and exposed from lower surface 31*a*2 of top plate 31*a* of header housing 31. Header shield terminal 35*b* is configured to be electrically connected to an outside of header housing 31. More specifically, header shield terminal 35*b* is configured to be electrically and mechanically connected to a wiring board on which header 30 is mounted by, e.g. soldering. As illustrated in FIG. 18, two terminals 35*b*1 having substantially the same shape are provided on both sides of header shield terminal 35*b* in directions D1 and D2. Therefore, when the lower surface of header shield element 35 is electrically and mechanically connected, at least one of three terminals 35*b* and 15*b*1 is connected to the board.

Lower-surface protrusion 35*a*2 having the same height as the lower surface of header shield terminal 35*b* with respect to lower surface 31*a*2 of top plate 31*a* is provided at a lower portion of the lower part of header shield terminal 35*a* of header shield element 35. Lower-surface protrusion 35*a*2 is configured to be electrically and mechanically connected to the wiring board by, e.g. soldering.

Side-surface protrusions 35*a*3 are provided on the outer side surfaces of header shield terminals 35*a* in directions D1 and D2, respectively. As illustrated in the cross-sectional view of FIG. 7, each portions of side-surface protrusion 35*a*3 facing respective one of the inner surfaces of header side wall connection portions 31*d* and 31*e* are engaged with the respective one of the inner surfaces of header side wall connection portions 31*d* and 31*e* during manufacturing, thereby increasing the holding force with which header housing 31 holds header shield element 35.

As illustrated in FIG. 7, while header 30 is fit to socket 20, header side wall connection portion 31*d* and one of two header shield terminals 35*a* of header shield element 35 are disposed between socket side wall connection portion 21*d* of socket housing 21 and one of two socket shield terminals 25*a* of socket shield element 25. The one of two header shield terminals 35*a* of header shield element 35 faces socket side wall connection portion 21*d* of socket housing 21 across header side wall connection portion 31*d* in directions D1 and D2. At this time, header side wall connection portion 31*e* and the other of two header shield terminals 35*a* of header shield element 35 are disposed between socket side wall connection portion 21*e* of socket housing 21 and the other of two socket shield terminals 25*a* of socket shield element 25. The other of two header shield terminals 35*a* of header shield element 35 faces socket side wall connection portion 21*e* of socket housing 21 across header side wall connection portion 31*e* in directions D1 and D2.

As the constituent material of header shield element 35, the same alloy or the like as the constituent material of outer shield element 24 and socket shield element 25 can be used.

As described above, header 30 according to the embodiment includes header shield element 35 held between header side wall portions 31*b* and 31*c* along directions D1 and D2 in which header side wall portions 31*b* and 31*c* extend. Therefore, header 30 functions together with the above-described socket shield element 25 as an electromagnetic shield for shielding electromagnetic coupling between header terminal elements 32 provided on header side wall portions 31*b* and 31*c* facing each other.

Connection Between Socket Shield Element and Header Shield Element

Connection between socket shield element 25 of socket 20 and header shield element 35 of header 30 will be detailed below, referring to FIG. 7.

As illustrated in FIG. 7, socket shield element 25 is held on the holding walls 21*f* and 21*g* with two protrusions 25*c*1 of holding portion 25*c* provided substantially at the center of socket shield element 25.

Two socket shield terminals 25*a* of socket shield element 25 are engaged with opposing surfaces 35*a*1 (see FIG. 18) of two header shield terminals 35*a* of header shield element 35 facing socket shield terminals 25*a*. As illustrated in FIG. 7, the cross sections of two socket shield terminals 25*a* and main body 25*p* below the terminals connected to two socket shield terminals 25*a* in directions D1 and D2, which are the long-side directions, have the shape of mho (reciprocal of Ω: Inverted OHM Sign), which is the old unit notation of conductance.

When socket shield element 25 is fit to header shield element 35, socket shield element 25 is compressed from the outside to the inside in the long side direction. That is, two socket shield terminals 25*a* located between two header shield terminals 35*a* along directions D1 and D2 are urged by two header shield terminals 35*a* in a direction in which two header shield terminals 35*a* approach each other. In this case, since the constituent material of socket shield element 25 has an appropriate elasticity, even after socket 20 is fit to header 30, socket shield element 25 is appropriately pressed against facing surface 35*a*1 of header shield terminal 35*a* of header shield element 35 by an urging force. Therefore, engaging portion 25*a*1 on the outside of each socket shield terminal 25*a* of socket shield element 25 securely contacts (point contact in the embodiment) facing surface 35*a*1 of each header shield terminal 35*a*.

In the above configuration, socket shield element 25 and header shield element 35 held on and connected electrically to different boards 101 and 102 by, e.g. soldering are connected to each other at the shortest distance possible by the contact (point contact) between socket shield terminal 25*a* and header shield terminal 35*a* located at respective both ends of socket shield element 25 and header shield element 35. As described above, header 30 and socket 20 are grounded at a short distance, accordingly improving high-frequency characteristics of the RF signals.

Structure of Socket Terminal and Header Terminal

Figure 19:
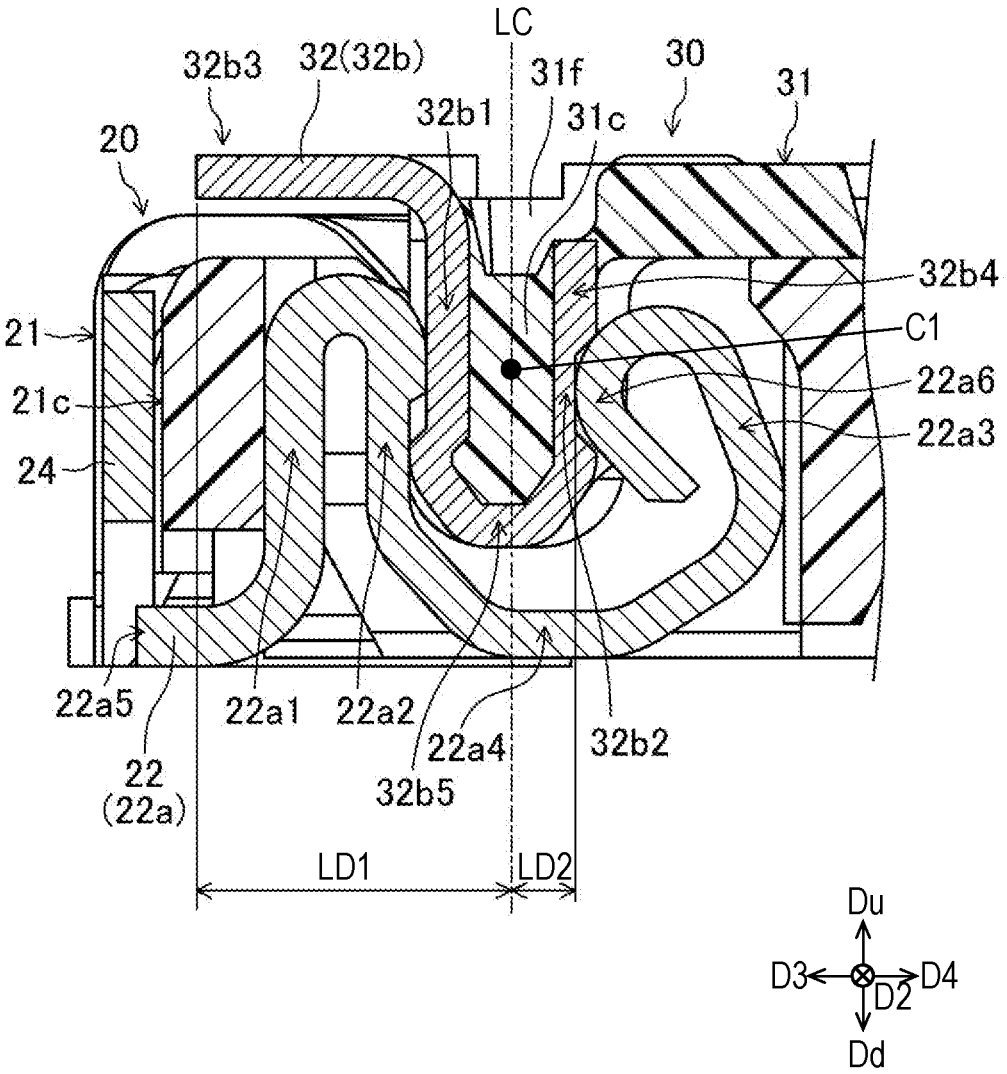
FIG. 19 is a partially enlarged cross-sectional view of the connector according to the embodiment illustrating connection of each terminal in a portion including a socket side wall portion of the socket and a header side wall portion of the header constituting the connector according to the embodiment of the present invention.

The configuration of the electrical connection between socket terminal element 22 of socket 20 and header terminal element 32 of header 30 will be described. FIG. 19 is an enlarged sectional view of a portion of the connector including socket side wall portion 21*c* and header side wall portion 31*c* illustrated in FIG. 4.

The configuration of header terminal element 32 will be firstly described below.

In FIG. 19, header side wall portion 31*c* of header housing 31 extends from base portion 31*f* in downward direction Dd. Header terminal elements 32 are arranged in direction D2 perpendicular to downward direction Dd. In accordance with the embodiment, all of the terminals have the same cross-sectional shape, and terminal 32*b* will be described here as an example.

Terminal 32*b* includes terminal extension portion 32*b*1 and terminal extension portion 32*b*2. Terminal extension portion 32*b*1 extends in downward direction Dd. Terminal extension portion 32*b*2 extends in upward direction Du opposite to downward direction Dd, and faces terminal extension portion 32*b*1 across header side wall portion 31*c*.

Terminal end portion 32*b*3 is located within in terminal 32*b* in direction D3 (a direction outside header 30) perpendicular to downward direction Dd and direction D1. Terminal end portion 32*b*3 is connected to terminal extension portion 32*b*2 via terminal extension portion 32*b*1. On the other hand, terminal end portion 32*b*4 is located within terminal 32*b* in direction D4 (a direction inside header 30) opposite to direction D3. Terminal end portion 32*b*4 is connected to terminal end portion 32*b*3 via terminal extension portion 32*b*2. Therefore, terminal extension portion 32*b*1 and terminal end portion 32*b*3 are located in direction D3 from terminal extension portion 32*b*2. Terminal end portion 32*b*3 is exposed from base portion 31*f* in direction D3.

As illustrated in FIG. 19, center line LC is defined as extending in downward direction Dd and passing through midpoint C1 that divides the distance between surfaces of terminal extension portions 32*b*1 and 32*b*2 facing each other in direction D3 (D4) evenly into halves. Distance LD1 from center line LC to terminal end portion 32*b*3 in direction D3 (D4) is larger than distance LD2 from center line LC to terminal end portion 32*b*4 in direction D3 (D4). Distances LD1 and LD2 are the shortest distances in direction D3 (D4) from center line LC to terminal end portions 32*b*3 and 32*b*4, respectively.

At this moment, terminal end portion 32*b*4 faces terminal extension portion 32*b*1 across center line LC and header side wall portion 31*c*. Terminal 32*b* further includes terminal connection portion 32*b*5 connecting terminal extension portion 32*b*1 to terminal extension portion 32*b*2. Terminal 32*b* include no portion facing terminal connection portion 32*b*5 across center line LC and header side wall portion 31*c*. This configuration prevents the creeping of the solder material from terminal 32*b* up to terminal extension portion 32*b*1.

In the above configuration, even if terminal 22*a* of socket 20 is connected to terminal extension portion 32*b*2 of terminal 32*b* of header 30, the distance of the signal path via terminal extension portion 32b2 is smaller than the distance from center line LC to terminal end portion 32b3. For this reason, the signal flowing in outer terminal extension portion 32b1 while outer terminal extension portion 32b1 is electrically connected to terminal 22a of socket 20 is less likely affected by a phase difference or the like. This configuration thus suppresses the deterioration of the high-frequency characteristics (isolation separation) of the RF signal.

The configuration of socket terminal element 22 will be described below.

In FIG. 19, socket terminal elements 22 are arranged in direction D1 (D2) on socket side wall portion 21c of socket housing 21 so as to correspond to header terminal elements 32. In accordance with the embodiment, all of the terminals of the socket terminal elements have the same cross-sectional shape, and terminal 22a is described as an example.

Terminal 22a includes terminal extension portion 22a1 extending in upward direction Du opposite to downward direction Dd, terminal extension portion 22a2 extending in downward direction Dd, and terminal extension portion 22a3 extending in upward direction Du. Terminal extension portion 22a2 faces terminal extension portion 22a1.

Terminal 22a further includes terminal connection portion 22a4 connecting terminal extension portion 22a2 to terminal extension portion 22a3. Terminal connection portion 22a4 is located in downward direction Dd from terminal 32b of header 30.

Terminal 22a includes terminal end portion 22a5 connected to terminal extension portion 32b1 via terminal extension portion 22a1 and terminal extension portion 22a2. That is, terminal end portion 22a5 is exposed in direction D3 from the lower portion of socket housing 21.

Terminal 22a includes terminal end portion 22a6 opposite to terminal end portion 22a5 in terminal extension portion 22a3. Terminal end portion 22a6 is bent in downward direction Dd so as to face terminal extension portion 22a2 and contacts terminal extension portion 32b2.

In the above-described configuration, terminal extension portion 22a2 of terminal 22a contacts, for example, terminal extension portion 32b1 of terminal 32b of header 30 to be electrically connected to terminal 32b. Simultaneously, terminal end portion 22a6 of terminal 22a contacts terminal extension portion 32b2 to be electrically connected to extension portion 32b2.

In accordance with the embodiment, terminal 22a of socket terminal element 22 is thus connected to terminal extension portion 32b1 of terminal 32b of header terminal element 32. Therefore, RF signals input and output through terminal end portion 22a5 of terminal 22a are input and output through terminal end portion 32b3 of terminal 32b mainly via terminal extension portion 32b1 located outside (direction D3). That is, an RF signal input from terminal end portion 22a5 is output from terminal end portion 32b3 with a relatively short path length.

In addition, in terminal 32b of header terminal element 32, distance LD2 from terminal end portion 32b4 to center line LC between terminal extension portion 32b1 and terminal extension portion 32b2 inside header 30 (opposite to direction D3) is smaller than distance LD1 from center line LC to terminal end portion 32b3 outside header 30. For this reason, while terminal 22a of terminal of socket terminal element 22 is connected to terminal extension portion 32b2 of terminal 32b, the path length of the signal via terminal extension portion 32b2 is relatively short. For this reason, while terminal 22a is electrically connected to terminal extension portion 32b1 is less affected by a phase difference or the like. As a result, isolation (insulation separation) of the RF signal is improved, and deterioration of high-frequency characteristics can be suppressed.

In accordance with the embodiment, as illustrated in FIGS. 14 and 15, terminals 32a to 32e of header 30 are arranged by pitches PA in directions D1 and D2. Width WB of terminals 32a to 32e in directions D1 and D2 is smaller than pitches PA. This configuration optimizes the impedance of connector 10. For example, the ratio of terminal width WB to pitch PA which is equal to or less than 60% allows the impedance of connector 10 to match 50Ω (nominal value). Note that width WB of each of terminals 32a to 32e is not a width of an outer end thereof connected to board 102, but a the width of a portion thereof connected directly to header side wall portions 31b and 31c, respectively.

Next, a mounting location of holding bracket 26 of socket 20 according to the embodiment will be described below. As illustrated in FIG. 8, mounting portion 26a of holding bracket 26 at each corner of socket housing 21 in holding bracket 26 may be soldered. This configuration prevents socket 20 or connector 10 from being peeled off even if an external stress is applied to socket 20 or connector 10 after the soldering.

As illustrated in FIG. 14, a portion of holding bracket 36 of header 30 located at each corner of header housing 31 may be used as mounting portion 36a to be soldered. This configuration prevents header 30 or connector 10 to from being peeled off due to an external stress applied thereto after the soldering.

Connector 10 according to the embodiment includes socket 20 and header 30 configured to be fit to socket 20. Socket 20 includes socket housing 21 including socket side wall portions 21b and 21c facing each other and provided on bottom plate 21a, socket terminal element 22 provided on an inner surface of socket side wall portion 21b and including at least one terminal 22a, and outer shield element 24 provided on an outer surface of socket side wall portion 21b. Outer shield element 24 includes main body 24a disposed on the outer surface, contact portion 24b extending from main body 24a to the inner side surface and configured to be electrically connected to an outside of socket housing 21, and outer shield terminal portion 24c extending from main body 24a toward bottom plate 21a and electrically connected to contact portion 24b via main body 24a.

This configuration allows contact portion 24b of outer shield element 24 to be electrically connected to, for example, a particular terminal of header 30. Further, outer shield terminal portion 24c extending from main body 24a toward bottom plate 21a is electrically connected to contact portion 24b via main body 24a. Therefore, outer shield terminal portion 24c may be electrically connected to, for example, a circuit board on which socket 20 is held. Upon having a ground potential applied thereto, outer shield element 24 suppresses unnecessary radiation and noise due to RF signals, and suppresses interference between RF signals.

In connector 10 according to the embodiment, outer shield element 24, contact portion 24b and outer shield terminal portion 24c of outer shield element 24 may be located on one axis.

This configuration decreases a path length between contact portion 24b and outer shield terminal portion 24c, and improving the high-frequency characteristics of the RF signal accordingly.

In connector 10 according to the embodiment, at least one terminal (terminal 22*a*) of socket terminal element 22 may be disposed inside a groove or a hole provided in bottom plate 21*a*.

This configuration lowers the position of header 30 (the surface on the side opposite to bottom plate 21*a* of socket 20 when header 30 is fit to socket 20, accordingly reducing the height dimension of connector 10.

In connector 10 according to the embodiment, socket 20 may include socket terminal element 22 provided on the inner surface of socket side wall portion 21*c* out of socket side wall portions 21*b* and 21*c* facing each other, and outer shield element 24 provided on the outer surface of socket side wall portion 21*c*. Outer shield element 24 may include main body 24*a* disposed on the outer surface, contact portion 24*b* extending from main body 24*a* to the inner surface and configured to be electrically connected to an outside of socket housing 21, and outer shield terminal portion 24*c* extending from main body 24*a* toward bottom plate 21*a* and electrically connected to contact portion 24*b* via main body 24*a*.

In this configuration of connector 10, socket terminal element 22 provided on socket side wall portion 21*c* facing socket side wall portion 21*b* allows a signal different from socket terminal element 22 of socket side wall portion 21*b* to be connected to socket terminal element 22 of socket side wall portion 21*c*.

In this case, connector 10 may further include socket shield element 25 provided between socket side wall portion 22*b* and socket side wall portion 21*c* along socket side wall portion 21*b* and socket side wall portion 21*c*. Socket shield element 25 may include socket shield terminal 25*a* extending above bottom plate 21*a*, and socket shield terminal 25*b* electrically connected to socket shield terminal 25*a*. Socket shield terminal 25*b* is exposed from the lower surface of bottom plate 21*a*, and is configured to be electrically connected to the outside of socket housing 21.

In this configuration, in the case that the ground potential is applied to socket shield terminal 25*b* of socket shield element 25 while socket shield terminal 25*a* of socket shield element 25 is electrically connected to header 30, the path of the ground potential via socket 20 to header 30 can be shortened.

In this case, connector 10 may further include holding wall 21*f* and holding wall 21*g*. Holding wall 21*f* is provided on bottom plate 21*a* at an inner side of socket side wall portion 21*b* and holds socket terminal element 22 extending from socket side wall portion 21*b*. Holding wall 21*g* is provided on bottom plate 21*a* at an inner side of socket side wall portion 21*c*, and holds socket terminal element 22 extending from socket side wall portion 21*c*. Socket shield element 25 may be held on holding wall 21*f* and holding wall 21*g*.

This configuration does not require another member for holding socket shield element 25 disposed inside socket 20, thus simplifying the configuration of socket 20 and reducing the cost.

In this case, the header 30 may include header housing 31, header terminal elements 32, and header shield element 35. Header housing 31 includes header side wall portions 31*b* and 31*c* provided on top plate 31*a* so as to face each other. One header terminal element 32 is provided on header side wall portion 31*b*. The other header terminal element 32 is provided on header side wall portion 31*c* and is electrically independent of header terminal element 32. Header shield element 35 is provided on top plate 31*a* and parallel with header side wall portions 31*b* and 31*c* between header side wall portions 31*b* and 31*c*.

In this configuration, header shield element 35 is also provided inside header housing 31. When header 30 is fit to socket 20, shield element 35 is electrically connected to socket shield element 25 easily and reliably.

In this case, socket terminal element 22 may include terminal 22*a* located in direction D1 along socket side wall portion 21*b* from contact portion 24*b*, and terminal 22*a* located in direction D2 opposite to direction D1 from contact portion 24*b*. Header terminal element 32 may include terminal 32*a* configured to contact portion 24*b* to be electrically connected to contact portion 24*b*, terminal 32*b* located in direction D1 from terminal 32*a* and electrically connected to terminal 22*a*, and terminal 32*c* located in direction D2 from terminal 32*a* and electrically connected to terminal 22*a*.

In the case that header 30 includes header shield element 35, header 30 may include at least holding bracket 36 provided on the outer side of header side wall portion 31*b* and header side wall portion 31*c*. Holding bracket 36 is provided both of opposite to side wall portion 31*b* with respect to side wall portion 31*c* and opposite to side wall portion 31*c* with respect to side wall portion 31*b*, Outer shield element 24 of socket 20 may include extension portion 24*d* extending from main body 24*a* to the inner surface. Each extension portion 24*d* may be electrically connected to holding bracket 36.

This configuration allows header 30 to be easily connected electrically to two outer shield elements 24 of socket 20 via holding bracket 36 provided on the outer portion of header 30.

In the case that header 30 includes header shield element 35, socket housing 21 may include socket side wall connection portion 21*d* connected to socket side wall portion 21*b* and socket side wall portion 21*c*. Header shield element 35 may include header shield terminal 35*a* configured to be electrically connected to socket 20. Header shield terminal 35*a* may be disposed in a region of header shield element 35 between socket shield terminal 25*a* and socket side wall connection portion 21*d*, and may be electrically connected to socket shield terminal 25*a*.

In this case, socket housing 21 may include socket side wall connection portion 21*e* facing socket side wall connection portion 21*d* and connected to socket side wall portion 21*b* and socket side wall portion 21*c*. Socket shield element 25 may include socket shield terminal 25*a* located between holding wall 21*f* and holding wall 21*g* at a side of socket side wall connection portion 21*e* with respect to socket shield terminal 25*b*. Header shield element 35 may include header shield terminal 35*a* configured to be located between socket shield terminal 25*a* and socket side wall connection portion 21*e* and to be electrically connected to socket shield terminal 25*a*.

In this case, header shield element 35 may include header shield terminal 35*a* and header shield terminal 35*b* electrically connected to header shield terminal 35*a* and being configured to be electrically connected to an outside of header housing 31.

In this configuration, the ground potential of the wiring board or the like on which header 30 is mounted may be directly applied to header shield element 35 by header shield element 35 provided on header 30.

Socket 20 according to the embodiment is fit to header 30 and includes socket housing 21, socket terminal element 22, and outer shield element 24. Socket housing 21 includes socket side wall portions 21*b* and 21*c* are provided on bottom plate 21*a* and face each other. Socket terminal element 22 is provided on an inner surface of socket side wall portion 21*b* and includes at least one terminal portion 22*a*. Outer shield element 24 is provided on the outer surface of socket side wall portion 21*b*. Outer shield element 24 includes main body 24*a* disposed on the outer surface, contact portion 24*b* extending from main body 24*a* to the inner side surface and electrically connected to the outside of socket housing 21, and outer shield terminal portion 24*c* extending from main body 24*a* toward bottom plate 21*a* and electrically connected to contact portion 24*b* via main body 24*a*.

According to this, outer shield element 24 includes main body 24*a* on outer surface may be provided, and outer shield element 24 includes contact portion 24*b* extending from main body 24*a* to the inner surface and configured to be electrically connected to the outside of socket housing 21. Contact portion 24*b* of outer shield element 24 may be electrically connected to, for example, a particular terminal of fitted header 30. Further, outer shield terminal portion 24*c* extends from main body 24*a* toward bottom plate 21*a* and is electrically connected to contact portion 24*b* via main body 24*a*. Outer shield terminal portion 24*c* may be electrically connected to, for example, a circuit board on which socket 20 is held. Upon having a ground potential applied to outer shield element 24, outer shield element 24 suppresses unnecessary radiation and noise due to RF signals, and suppresses interference between RF signals.

In the socket according to the embodiment, in outer shield element 24, contact portion 24*b* and outer shield terminal portion 24*c* may be located on one axis.

In socket 20 according to the embodiment, at least one terminal (e.g. terminal 22*a*) of socket terminal element 22 may be disposed inside a groove or a hole provided in bottom plate 21*a*.

Socket 20 according to the embodiment may further include socket terminal element 22 provided on the inner surface of socket side wall portion 21*c*, and outer shield element 24 provided on the outer surface of socket side wall portion 21*c*. Outer shield element 24 may include main body 24*a* disposed on the outer surface, contact portion 24*b* extending from main body 24*a* to the inner surface and configured to be electrically connected to the an outside of socket housing 21, and outer shield terminal portion 24*c* extending from main body 24*a* toward bottom plate 21*a* and electrically connected to contact portion 24*b* via main body 24*a*.

In the embodiment, terms indicating directions, such as "upper surface" and "upward", indicate relative directions determined only by relative positional relationships between components of connector 10, and do not indicate absolute directions, such as a vertical direction.

What is claimed is:

1. A connector comprising:

a socket; and a header configured to be fit into the socket, wherein:

the socket includes:

a socket housing including a bottom plate, a first side wall portion extending upward from an upper surface of the bottom plate, the first side wall portion extending in a first direction perpendicular to an upward direction, and a second side wall portion extending upward from the upper surface of the bottom plate, the second side wall portion extending in the first direction to face the first side wall portion in a second direction perpendicular to the first direction;

a first socket terminal element provided on an inner surface of the first side wall portion facing the second side wall portion, the first socket terminal element including a first terminal and a second terminal which are arranged in the first direction; and a first outer shield element provided on an outer surface of the first side wall portion opposite to the inner surface of the first side wall portion, the first outer shield element includes:

a first main body disposed on the outer surface of the first side wall portion;

a first contact portion extending from the first main body to the inner surface of the first side wall portion, the first contact portion being configured to contact and be electrically connected to the header; and a first outer shield terminal portion extending downward from the first main body, the first outer shield terminal portion being electrically connected to the first contact portion via the first main body, and the first contact portion of the first outer shield element is located between the first terminal and the second terminal of the first socket terminal element when viewed in the second direction.

2. The connector of claim 1, wherein the first contact portion and the first outer shield terminal portion of the first outer shield element are located on an axis.

3. The connector of claim 1, wherein the bottom plate has a recess provided therein, the first terminal of the first socket terminal element being disposed in the recess.

4. The connector of claim 1, wherein:

the socket further includes:

a second socket terminal element provided on an inner surface of the second side wall portion facing the first side wall portion; and a second outer shield element provided on an outer side of the second side wall portion opposite to the inner surface of the second side wall portion, and the second outer shield element includes:

a second main body disposed on the outer surface of the second side wall portion;

a second contact portion extending from the second main body to the inner side surface, the second contact portion being configured to contact and be electrically connected to the header; and a second outer shield terminal portion extending downward from the second main body, the second outer shield terminal portion being electrically connected to the second contact portion via the second main body.

5. The connector of claim 4, wherein:

the socket is configured to be mounted to a wiring board, the socket further includes a socket shield element provided between the first side wall portion and the second side wall portion along the first side wall portion and the second side wall portion, and the socket shield element includes:

a first socket shield terminal located in an upward direction from the bottom plate; and a second socket shield terminal electrically connected to the first socket shield terminal and exposed from a lower surface of the bottom plate, the second socket shield terminal being configured to be electrically connected to the wiring board.

6. The connector of claim 5, wherein:

the first socket terminal element includes a part extending from the first side wall portion, the second socket terminal element includes a part extending from the second side wall portion, the socket housing further includes:

a first holding wall extending upward from the upper surface of the bottom plate between the first side wall portion and the second side wall portion, the part of the first socket terminal element extending from the first side wall portion being disposed at the first holding wall; and a second holding wall extending upward from the upper surface of the bottom plate between the second side wall portion and the first holding wall, the part of the second socket terminal element extending from the second side wall portion being disposed at the second holding wall, and at least one of the first holding wall or the second holding wall holds the socket shield element.

7. The connector of claim 6, wherein the header includes:

a header housing including a top plate, a third side wall portion extending downward from a lower surface of the top plate, the third side wall portion extending in the first direction, and a fourth side wall portion extending downward from the lower surface of the top plate, the fourth side wall portion extending in the first direction to face the third side wall portion;

a first header terminal element provided on the third side wall portion;

a second header terminal element provided on the fourth side wall portion, the second header terminal element being electrically independent of the first header terminal element; and a header shield element provided between the third side wall portion and the fourth side wall portion, the header shield element extending in the first direction.

8. The connector of claim 7, wherein:

the first terminal of the first socket terminal element is located in the first direction from the first contact portion, the second terminal is located in a third direction opposite to the first direction from the first contact portion, and the first header terminal element includes:

a third terminal configured to contact the first contact portion to be electrically connected to the first contact portion;

a fourth terminal located in the first direction from the third terminal, the fourth terminal being configured to be electrically connected to the first terminal; and a fifth terminal located in the third direction from the third terminal, the fifth terminal being configured to be electrically connected to the second terminal.

9. The connector of claim 7, wherein the header further includes a holding bracket provided both of opposite to the fourth side wall portion with respect to the third side wall portion and opposite to the fourth side wall portion with respect to the third side wall portion, the first outer shield element of the socket includes a first extension portion extending from the first main body along the inner surface of the first socket side wall portion, the second outer shield element of the socket includes a second extension portion extending from the second main body along the inner surface of the second socket side wall portion, and the first extension portion and the second extension portion are electrically connected to the holding bracket.

10. The connector of claim 7, wherein the socket housing further includes a first side wall connection portion connected to the first side wall portion and the second side wall portion, the header shield element includes a first header shield terminal configured to be electrically connected to the socket, and the first header shield terminal is configured to be disposed between the first socket shield terminal and the first side wall connection portion and to be electrically connected to the first socket shield terminal.

11. The connector of claim 10, wherein the socket housing further includes a second side wall connection portion connected to the first side wall portion and the second side wall portion, the second side wall connection portion facing the first side wall connection portion, the socket shield element further includes a third socket shield terminal located between the second socket shield terminal and the second side wall connection portion and between the first holding wall and the second holding wall, and the header shield element includes a second header shield terminal configured to be located between the third socket shield terminal and the second side wall connection portion so as to be electrically connected to the third socket shield terminal.

12. The connector of claim 11, wherein the header shield element further includes a third header shield terminal electrically connected to the first header shield terminal and the second header shield terminal, the third header shield terminal being configured to contact and be electrically connected to the socket.

13. A socket configured to be fit to a header, the socket comprising:

a socket housing including a bottom plate, a first side wall portion extending upward from an upper surface of the bottom plate, the first side wall portion extending in a first direction perpendicular to an upward direction, and a second side wall portion extending upward from the upper surface of the bottom plate, the second side wall portion extending in the first direction to face the first side wall portion in a second direction perpendicular to the first direction;

a first socket terminal element provided on an inner surface of the first side wall portion facing the second side wall portion, the first socket terminal element including a first terminal and a second terminal, which are arranged in the first direction; and a first outer shield element provided on an outer surface of the first side wall portion opposite to the inner surface of the first side wall portion, wherein:

the first outer shield element includes:

a first main body disposed on the outer surface of the first side wall portion;

a first contact portion extending from the first main body to the inner side surface of the first side wall portion, the first contact portion being configured to contact and be electrically connected to the header; and a first outer shield terminal portion extending downward from the first main body, the first outer shield terminal portion being electrically connected to the first contact portion via the first main body, and the first contact portion of the first outer shield element is located between the first terminal and the second terminal of the first socket terminal element when viewed in the second direction.

14. The socket of claim 13, wherein the first contact portion and the first outer shield terminal portion of the first outer shield element are located on an axis.

15. The socket of claim 13, wherein the bottom plate has a recess provided therein, the first terminal of the first socket terminal element being disposed in the recess.

16. The socket of claim 13, further comprising:

a second socket terminal element provided on an inner surface of the second side wall portion facing the first side wall portion; and a second outer shield element provided on an outer side of the second side wall portion opposite to the inner surface of the second side wall portion, wherein the second outer shield element includes:

a second main body disposed on the outer surface of the second side wall portion;

a second contact portion extending from the second main body to the inner surface, the second contact portion being configured to contact and be electrically connected to the header; and a second outer shield terminal portion extending downward from the second main body, the second outer shield terminal portion being electrically connected to the second contact portion via the second main body.

17. A connector comprising:

a socket; and a header configured to be fit into the socket, wherein:

the socket includes:

a socket housing including a bottom plate, a first side wall portion extending upward from an upper surface of the bottom plate, the first side wall portion extending in a first direction perpendicular to an upward direction, and a second side wall portion extending upward from the upper surface of the bottom plate, the second side wall portion extending in the first direction to face the first side wall portion;

a first socket terminal element provided on an inner surface of the first side wall portion facing the second side wall portion, the first socket terminal element including a first terminal; and a first outer shield element provided on an outer surface of the first side wall portion opposite to the inner surface of the first side wall portion, the first outer shield element includes:

a first main body disposed on the outer surface of the first side wall portion;

a first contact portion extending from the first main body to the inner surface of the first side wall portion, the first contact portion being configured to contact and be electrically connected to the header; and a first outer shield terminal portion extending downward from the first main body, the first outer shield terminal portion being electrically connected to the first contact portion via the first main body, the socket further includes:

a second socket terminal element provided on an inner surface of the second side wall portion facing the first side wall portion; and a second outer shield element provided on an outer side of the second side wall portion opposite to the inner surface of the second side wall portion, the second outer shield element includes:

a second main body disposed on the outer surface of the second side wall portion;

a second contact portion extending from the second main body to the inner side surface, the second contact portion being configured to contact and be electrically connected to the header; and a second outer shield terminal portion extending downward from the second main body, the second outer shield terminal portion being electrically connected to the second contact portion via the second main body, the socket is configured to be mounted to a wiring board, the socket further includes a socket shield element provided between the first side wall portion and the second side wall portion along the first side wall portion and the second side wall portion, the socket shield element includes:

a first socket shield terminal located in an upward direction from the bottom plate; and a second socket shield terminal electrically connected to the first socket shield terminal and exposed from a lower surface of the bottom plate, the second socket shield terminal being configured to be electrically connected to the wiring board, the first socket terminal element includes a part extending from the first side wall portion, the second socket terminal element includes a part extending from the second side wall portion, the socket housing further includes:

a first holding wall extending upward from the upper surface of the bottom plate between the first side wall portion and the second side wall portion, the part of the first socket terminal element extending from the first side wall portion being disposed at the first holding wall; and a second holding wall extending upward from the upper surface of the bottom plate between the second side wall portion and the first holding wall, the part of the second socket terminal element extending from the second side wall portion being disposed at the second holding wall, the first holding wall and the second holding wall hold the socket shield element, the header includes:

a header housing including a top plate, a third side wall portion extending downward from a lower surface of the top plate, the third side wall portion extending in the first direction, and a fourth side wall portion extending downward from the lower surface of the top plate, the fourth side wall portion extending in the first direction to face the third side wall portion;

a first header terminal element provided on the third side wall portion;

a second header terminal element provided on the fourth side wall portion, the second header terminal element being electrically independent of the first header terminal element; and a header shield element provided between the third side wall portion and the fourth side wall portion, the header shield element extending in the first direction, the first terminal of the first socket terminal element is located in the first direction from the first contact portion, the first socket terminal element further includes a second terminal located in a second direction opposite to the first direction from the first contact portion, and the first header terminal element includes:

a third terminal configured to contact the first contact portion to be electrically connected to the first contact portion;

a fourth terminal located in the first direction from the third terminal, the fourth terminal being configured to be electrically connected to the first terminal; and a fifth terminal located in the second direction from the third terminal, the fifth terminal being configured to be electrically connected to the second terminal.

18. A connector comprising:

a socket; and a header configured to be fit into the socket, wherein:

the socket includes:

a socket housing including a bottom plate, a first side wall portion extending upward from an upper surface of the bottom plate, the first side wall portion extending in a first direction perpendicular to an upward direction, and a second side wall portion extending upward from the upper surface of the bottom plate, the second side wall portion extending in the first direction to face the first side wall portion;

a first socket terminal element provided on an inner surface of the first side wall portion facing the second side wall portion, the first socket terminal element including a first terminal; and a first outer shield element provided on an outer surface of the first side wall portion opposite to the inner surface of the first side wall portion, the first outer shield element includes:

a first main body disposed on the outer surface of the first side wall portion;

a first contact portion extending from the first main body to the inner surface of the first side wall portion, the first contact portion being configured to contact and be electrically connected to the header; and a first outer shield terminal portion extending downward from the first main body, the first outer shield terminal portion being electrically connected to the first contact portion via the first main body, the socket further includes:

a second socket terminal element provided on an inner surface of the second side wall portion facing the first side wall portion; and a second outer shield element provided on an outer side of the second side wall portion opposite to the inner surface of the second side wall portion, the second outer shield element includes:

a second main body disposed on the outer surface of the second side wall portion;

a second contact portion extending from the second main body to the inner side surface, the second contact portion being configured to contact and be electrically connected to the header; and a second outer shield terminal portion extending downward from the second main body, the second outer shield terminal portion being electrically connected to the second contact portion via the second main body, the socket is configured to be mounted to a wiring board, the socket further includes a socket shield element provided between the first side wall portion and the second side wall portion along the first side wall portion and the second side wall portion, the socket shield element includes:

a first socket shield terminal located in an upward direction from the bottom plate; and a second socket shield terminal electrically connected to the first socket shield terminal and exposed from a lower surface of the bottom plate, the second socket shield terminal being configured to be electrically connected to the wiring board, the first socket terminal element includes a part extending from the first side wall portion, the second socket terminal element includes a part extending from the second side wall portion, the socket housing further includes:

a first holding wall extending upward from the upper surface of the bottom plate between the first side wall portion and the second side wall portion, the part of the first socket terminal element extending from the first side wall portion being disposed at the first holding wall; and a second holding wall extending upward from the upper surface of the bottom plate between the second side wall portion and the first holding wall, the part of the second socket terminal element extending from the second side wall portion being disposed at the second holding wall, the first holding wall and the second holding wall hold the socket shield element, the header includes:

a header housing including a top plate, a third side wall portion extending downward from a lower surface of the top plate, the third side wall portion extending in the first direction, and a fourth side wall portion extending downward from the lower surface of the top plate, the fourth side wall portion extending in the first direction to face the third side wall portion;

a first header terminal element provided on the third side wall portion;

a second header terminal element provided on the fourth side wall portion, the second header terminal element being electrically independent of the first header terminal element; and a header shield element provided between the third side wall portion and the fourth side wall portion, the header shield element extending in the first direction, the header further includes a holding bracket provided both of opposite to the fourth side wall portion with respect to the third side wall portion and opposite to the fourth side wall portion with respect to the third side wall portion, the first outer shield element of the socket includes a first extension portion extending from the first main body along the inner surface of the first socket side wall portion, the second outer shield element of the socket includes a second extension portion extending from the second main body along the inner surface of the second socket side wall portion, and the first extension portion and the second extension portion are electrically connected to the holding bracket.

19. A connector comprising:

a socket; and a header configured to be fit into the socket, wherein:

the socket includes:

a socket housing including a bottom plate, a first side wall portion extending upward from an upper surface of the bottom plate, the first side wall portion extending in a first direction perpendicular to an upward direction, and a second side wall portion extending upward from the upper surface of the bottom plate, the second side wall portion extending in the first direction to face the first side wall portion;

a first socket terminal element provided on an inner surface of the first side wall portion facing the second side wall portion, the first socket terminal element including a first terminal; and a first outer shield element provided on an outer surface of the first side wall portion opposite to the inner surface of the first side wall portion, the first outer shield element includes:

a first main body disposed on the outer surface of the first side wall portion;

a first contact portion extending from the first main body to the inner surface of the first side wall portion, the first contact portion being configured to contact and be electrically connected to the header; and a first outer shield terminal portion extending downward from the first main body, the first outer shield terminal portion being electrically connected to the first contact portion via the first main body, the socket further includes:

a second socket terminal element provided on an inner surface of the second side wall portion facing the first side wall portion; and a second outer shield element provided on an outer side of the second side wall portion opposite to the inner surface of the second side wall portion, and the second outer shield element includes:

a second main body disposed on the outer surface of the second side wall portion;

a second contact portion extending from the second main body to the inner side surface, the second contact portion being configured to contact and be electrically connected to the header; and a second outer shield terminal portion extending downward from the second main body, the second outer shield terminal portion being electrically connected to the second contact portion via the second main body, the socket is configured to be mounted to a wiring board, the socket further includes a socket shield element provided between the first side wall portion and the second side wall portion along the first side wall portion and the second side wall portion, the socket shield element includes:

a first socket shield terminal located in an upward direction from the bottom plate; and a second socket shield terminal electrically connected to the first socket shield terminal and exposed from a lower surface of the bottom plate, the second socket shield terminal being configured to be electrically connected to the wiring board, the first socket terminal element includes a part extending from the first side wall portion, the second socket terminal element includes a part extending from the second side wall portion, the socket housing further includes:

a first holding wall extending upward from the upper surface of the bottom plate between the first side wall portion and the second side wall portion, the part of the first socket terminal element extending from the first side wall portion being disposed at the first holding wall; and a second holding wall extending upward from the upper surface of the bottom plate between the second side wall portion and the first holding wall, the part of the second socket terminal element extending from the second side wall portion being disposed at the second holding wall, the first holding wall and the second holding wall hold the socket shield element, the header includes:

a header housing including a top plate, a third side wall portion extending downward from a lower surface of the top plate, the third side wall portion extending in the first direction, and a fourth side wall portion extending downward from the lower surface of the top plate, the fourth side wall portion extending in the first direction to face the third side wall portion;

a first header terminal element provided on the third side wall portion;

a second header terminal element provided on the fourth side wall portion, the second header terminal element being electrically independent of the first header terminal element; and a header shield element provided between the third side wall portion and the fourth side wall portion, the header shield element extending in the first direction, the socket housing further includes a first side wall connection portion connected to the first side wall portion and the second side wall portion, the header shield element includes a first header shield terminal configured to be electrically connected to the socket, and the first header shield terminal is configured to be disposed between the first socket shield terminal and the first side wall connection portion and to be electrically connected to the first socket shield terminal.

* * * * *